US011259559B2

(12) United States Patent
Kaufmann et al.

(10) Patent No.: US 11,259,559 B2
(45) Date of Patent: Mar. 1, 2022

(54) COMPACTION APPARATUS AND RELATED METHODS

(71) Applicant: CANOPY GROWTH CORPORATION, Smiths Falls (CA)

(72) Inventors: Ben Kaufmann, Chelsea (CA); Rod Muir, South Mountain (CA); Mike Sirois, Ottawa (CA); Jessica Kara Smith, Perth (CA)

(73) Assignee: CANOPY GROWTH CORPORATION, Smiths Falls (CA)

( * ) Notice: Subject to any disclaimer, the term of this patent is extended or adjusted under 35 U.S.C. 154(b) by 540 days.

(21) Appl. No.: 16/391,468

(22) Filed: Apr. 23, 2019

(65) Prior Publication Data

US 2019/0320709 A1 Oct. 24, 2019

Related U.S. Application Data

(60) Provisional application No. 62/810,017, filed on Feb. 25, 2019, provisional application No. 62/810,010, filed on Feb. 25, 2019, provisional application No. 62/661,348, filed on Apr. 23, 2018.

(51) Int. Cl.

| | |
|---|---|
| ***A24C 5/06*** | (2006.01) |
| ***A24C 5/54*** | (2006.01) |
| ***A24D 1/02*** | (2006.01) |

(52) U.S. Cl.

CPC ..... *A24C 5/06* (2013.01); *A24C 5/54* (2013.01); *A24D 1/02* (2013.01)

(58) Field of Classification Search

CPC ..... A24C 5/02; A24C 5/06; A24C 5/42

See application file for complete search history.

(56) References Cited

U.S. PATENT DOCUMENTS

| | | | | |
|---|---|---|---|---|
| 9,814,259 | B1 * | 11/2017 | Richmond | A24B 7/04 |
| 2008/0264432 | A1 | 10/2008 | Moser | |
| 2016/0120212 | A1 | 5/2016 | Heidtmann | |
| 2017/0119043 | A1 | 5/2017 | Swanson | |

FOREIGN PATENT DOCUMENTS

| | | | |
|---|---|---|---|
| WO | 02056714 | A1 | 7/2002 |
| WO | 2017/172844 | A1 | 5/2017 |

OTHER PUBLICATIONS

International Search Report and Written Opinion issued in PCT/CA2019/050500, dated Jun. 20, 2019, 7 pages.

* cited by examiner

*Primary Examiner* — Eric Yaary
(74) *Attorney, Agent, or Firm* — Stinson LLP

(57) ABSTRACT

A compaction apparatus for compacting a smokeable product in production of smoking articles includes: (a) a frame for removably receiving a cone pallet. The cone pallet includes a plurality of cavities. Each cavity holds a cone filled with a volume of the smokeable product. The apparatus further includes (b) a compaction mechanism including: (i) at least one pin alignable above an open upper end of a respective cone and movable from a retracted position, in which the pin is spaced apart from the smokeable product in the cone, toward an advanced position for inserting a lower portion of the pin into the volume of the smokeable product. The compaction mechanism further includes (ii) a vibratory drive coupled to the pin and operable to vibrate the pin when the lower portion of the pin is within the volume of the smokeable product for inducing settlement of the smokeable product.

45 Claims, 17 Drawing Sheets

COMPACTION APPARATUS AND RELATED METHODS

CROSS-REFERENCE TO RELATED APPLICATIONS

This application is based on and claims priority to U.S. Provisional Application Ser. No. 62/661,348 filed Apr. 23, 2018; U.S. Provisional Application Ser. No. 62/810,010 filed Feb. 25, 2019; and U.S. Provisional Application Ser. No. 62/810,017 filed Feb. 25, 2019, each of which is incorporated herein by reference in its entirety.

STATEMENT REGARDING FEDERALLY SPONSORED RESEARCH OR DEVELOPMENT

Not applicable.

STATEMENT REGARDING JOINT RESEARCH AGREEMENT

Not applicable.

BACKGROUND OF THE INVENTION

1. Field of the Invention

The specification relates generally to production of smoking articles, and more specifically, to apparatuses and methods for compacting a smokeable product in production of conical smoking articles.

2. Description of Related Art

Int. Pub. No. WO 2017/172844 A1 discloses an apparatus including a holder plate and a carriage assembly. The holder plate includes a plurality of through-holes configured to receive containers having an interior cavity. The carriage assembly comprises one or more carriage plates and tamper rods, the carriage plates having a plurality of through-holes. Each of the tamper rods can be slidably disposed in a respective one of the plurality of through-holes of the carriage plate. Each of the tamper rods can be independently weighted to provide a force independent of the other of the tamper rods and can be independently movable relative to the other of the tamper rods. The carriage assembly can be configured to be aligned with the holder plate such that the each of the tamper rods provides a compressive force to a filler material within the interior cavity of each of the containers.

U.S. Pat. App. Pub. No. 2016/0120212 A1 discloses a tube filling apparatus. The apparatus includes a base and a filling assembly mountable on the base. The filling assembly has a number of tube receiving recesses wherein tubes may, in use, be received. The apparatus further includes a vibration plate which is locatable between the base and the filling assembly. In use, the tubes rest on the vibration plate when they are located in the recesses. The apparatus also includes vibrating means which is connected to the vibration plate for, in use, vibrating the vibration plate, which is capable of moving independently from the filling assembly.

BRIEF SUMMARY OF THE INVENTION

The following summary is intended to introduce the reader to various aspects of the applicant's teaching, but not to define any invention.

According to some aspects, a compaction apparatus for compacting a smokeable product in production of smoking articles, comprises: (a) a frame for removably receiving a cone pallet, the cone pallet including a plurality of cavities, each cavity holding a respective cone filled with a volume of the smokeable product, each cone having an open upper end; and (b) a compaction mechanism positionable above the cone pallet. The compaction mechanism includes: (i) at least one pin extending along a pin axis and alignable above the open upper end of a respective cone, and when aligned. The pin is movable vertically relative to the cone pallet from a retracted position, in which the pin is spaced apart from the smokeable product in the respective cone, toward an advanced position for inserting a lower portion of the pin into the volume of the smokeable product in the respective cone. The compaction mechanism further includes (ii) a vibratory drive coupled to the pin. The vibratory drive is operable to vibrate the pin when the lower portion of the pin is within the volume of the smokeable product of the respective cone for inducing settlement of the smokeable product.

In some examples, the compaction mechanism includes (iii) a collar positionable in the open upper end of the cone atop the smokeable product for generally covering the open upper end when the pin is in the advanced position.

In some examples, the collar has an interior aperture for slidably receiving the pin therethrough, and when the collar is positioned atop the smokeable product, the pin translates relative to the collar during movement toward the advanced position.

In some examples, the collar includes a front face for bearing against an upper surface of the smokeable product in the respective cone for exerting a compressive force on the smokeable product.

In some examples, the apparatus further includes a plunger attached to the pin above a rear face of the collar. The rear face is opposite the front face. The plunger is spaced apart from the rear face of the collar when the pin is in the retracted position, and the plunger bears against the rear face of the collar when the pin is in the advanced position for pushing the collar downwardly to exert the compressive force.

In some examples, the collar is formed of a generally rigid material, and the plunger is formed of a generally elastic material.

In some examples, each cavity has a cavity height between an upper end of the cavity and a lower end of the cavity, and wherein the pin advances through at least 20% of the cavity height when moving toward the advanced position.

In some examples, the pin advances through at least 50% of the cavity height when moving toward the advanced position. In some examples, the pin advances through at least 70% of the cavity height when moving toward the advanced position.

In some examples, the vibratory drive is tunable to adjust at least one of a vibration frequency and a vibration amplitude for vibrating the pin.

In some examples, the pin has a pin outer diameter greater than 1.1 mm. In some examples, the pin outer diameter is greater than 1.3 mm.

In some examples, the vibratory drive is operable to initiate vibration of the pin prior to insertion of the pin into the volume of the smokeable product.

According to some aspects, a method of compacting a smokeable product in a cone for production of smoking articles, comprises: (a) positioning a respective cone of a cone pallet in alignment with a pin, the cone containing a volume of the smokeable product and having an open upper end; (b) advancing the pin into the volume of the smokeable product through the open upper end of the cone; and (c) when the pin is in the volume of the smokeable product, vibrating the pin to induce settlement of the smokeable product in the cone.

In some examples, the method further comprises (d) positioning a collar in the open upper end of the cone atop the smokeable product to generally cover the open upper end when the pin is in the volume of the smokeable product.

In some examples, the method further comprises (e) urging the collar downwardly to exert a compressive force on the smokeable product.

In some examples, step (c) and step (e) are performed simultaneously.

In some examples, the collar is urged downwardly via a plunger attached to the pin above the collar.

In some examples, step (e) includes exerting the compressive force for at least 8 seconds.

In some examples, step (b) includes advancing the pin through the collar while the collar is atop the smokeable product.

In some examples, the method further comprises withdrawing the pin from the smokeable product while the collar is atop the smokeable product.

In some examples, the method further comprises vibrating the pin while the pin is being advanced through the smokeable product.

In some examples, the method further comprises vibrating the pin while the pin is being withdrawn from the smokeable product.

In some examples, step (c) includes vibrating the pin for at least 8 seconds.

In some examples, the method further comprises tuning at least one of a vibration frequency and a vibration amplitude for vibrating the pin.

In some examples, the method further comprises initiating vibration of the pin prior to advancement of the pin into the volume of the smokeable product.

In some examples, the method further comprises after step (b), reciprocating the pin along a vertical axis in the volume of the smokeable product.

In some examples, the reciprocating step includes vertically translating a tip of the pin in successive strokes over a time period between a lower limit and an upper limit above the lower limit, and raising the lower limit over the time period.

In some examples, the reciprocating step includes raising the upper limit over the time period. In some examples, the raising of the upper and lower limits is coordinated to maintain a generally common stroke length of the pin over the time period.

In some examples, the upper limit remains at a generally common elevation over the time period to reduce a stroke length of the pin when the lower limit is raised.

In some examples, the method further comprises, after step (c), withdrawing the pin from the volume of the smokeable product and urging a tamping face downwardly against an upper surface of the smokeable product to exert a compressive force thereon.

In some examples, the method further comprises translating the pin relative to a tamping collar through which the pin extends to bring a tip of the pin and an annular front face of the collar into vertical alignment for forming the tamping face.

According to some aspects, a compaction apparatus for compacting a smokeable product in production of smoking articles, comprises: (a) a frame defining at least one station for removably receiving a cone pallet, the cone pallet including a plurality of cavities, each cavity configured to hold a respective cone filled with a volume of smokeable product; (b) a compaction mechanism positionable above the cone pallet when the cone pallet is received in the station. The compaction mechanism includes: (i) at least one pin extending along a pin axis and alignable with a respective cavity, and when aligned, the pin movable vertically relative to the cone pallet from a pin retracted position distal the cone pallet toward a pin advanced position proximate the cone pallet for inserting a lower portion of the pin into the volume of smokeable product in the cone in the respective cavity; and (ii) a vibratory drive coupled to the pin, the vibratory drive operable to vibrate the pin at least when the pin is in the pin advanced position.

In some examples, the compaction mechanism further includes at least one tamping collar having an annular front face directed toward the cone pallet and an interior aperture open to the front face and receiving a respective pin, the collar axially movable relative to the pin between a collar rearward position and a collar forward position.

In some examples, when the collar is in the collar rearward position, the lower portion of the pin projects downwardly from the front face of the collar to facilitate movement of the pin toward the pin advanced position, and when the collar is in the collar forward position, the annular front face of the collar and a tip of the pin form a tamping face. The tamping face is moveable from a tamping retracted position distal the cone pallet to a tamping advanced position proximate the cone pallet for urging the tamping face downwardly against an upper surface of the volume of smokeable product to exert a compressive force thereon.

In some examples, the annular front face of the collar and the tip of the pin are generally flush when the collar is in the collar forward position.

In some examples, the compaction mechanism further includes: a pin carrier supported by the frame and holding the at least one pin; a tamper carrier supported by the frame and holding the at least one tamping collar; and an actuator operable to translate the tamper carrier relative to the pin carrier for moving the at least one collar between the collar rearward and collar forward positions.

In some examples, the tamper carrier is releasably fixable in position relative to the pin carrier when the collar is in the collar forward position.

In some examples, the compaction mechanism includes at least one tamping rod spaced apart from the pin and having a tamping face alignable with a respective cavity.

In some examples, the tamping face is moveable relative to the cone pallet from a tamping retracted position distal the cone pallet to a tamping advanced position proximate the cone pallet for urging the tamping face downwardly against an upper surface of the volume of smokeable product to exert a compressive force thereon.

In some examples, the pin tip has a pint tip diameter, and the tamping face has a tamping face diameter greater than the pin tip diameter.

In some examples, the frame has a first station below the at least one pin and a second station below the at least one tamping rod and spaced horizontally apart from the first station, and the cone pallet is moveable relative to the frame from the first station to the second station.

In some examples, when the cone pallet is in the first station, the at least one pin is alignable with the respective cavity, and when the cone pallet is in the second station, the tamping face of the at least one rod is alignable with the respective cavity.

In some examples, the compaction mechanism includes a rotatable carriage mounted to the frame, the carriage including a first side from which the at least one pin projects and a second side spaced rotationally apart from the first side and from which the at least one tamping rod projects.

In some examples, the carriage is rotatable relative to the frame between a first position, in which the first side and the at least one pin are directed toward the cone pallet, and a second position in which the second side and the tamping face of the at least one tamping rod are directed toward the cone pallet.

In some examples, the compaction mechanism includes a carriage movably supported by the frame, and one of the at least one pin and the at least one tamping rod is mounted to the carriage.

In some examples, the carriage is movable between a carriage retracted position and a carriage advanced position. When the carriage is in the carriage retracted position, the one of the at least one pin and the at least one tamping rod is horizontally clear of the cone pallet, and when the carriage is in the carriage advanced position, the one of the at least one pin and the at least one tamping rod is alignable with the respective cavity of the cone pallet.

In some examples, the other one of the at least one pin and the at least one tamping rod is supported by the frame above the cone pallet and in alignment with the respective cavity.

In some examples, the at least one pin is supported by the frame, and the at least one tamping rod is supported by the carriage. The at least one tamping rod is aligned with, and spaced vertically below, the at least one pin when the carriage is in the carriage advanced position.

In some examples, the compaction mechanism further includes a pallet actuator for vertically translating the cone pallet away from and towards a pallet lowered position, the pallet lowered position corresponding to the pin retracted position and the tamping retracted position.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

BRIEF DESCRIPTION OF THE DRAWINGS

The drawings included herewith are for illustrating various examples of articles, methods, and apparatuses of the present specification and are not intended to limit the scope of what is taught in any way. In the drawings.

DETAILED DESCRIPTION OF PREFERRED EMBODIMENT

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors, or owners do not intend to abandon, disclaim, or dedicate to the public any such invention by its disclosure in this document.

Figure 1:
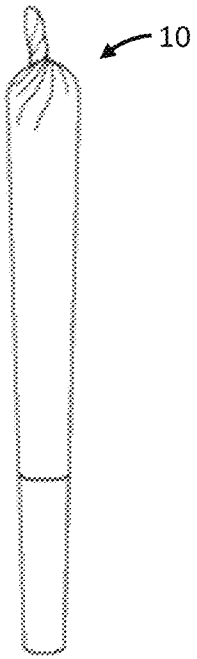
FIG. 1 is a perspective view of an example conical smoking article.

Smoking articles having a conical shape, like that of the example smoking article 10 shown in FIG. 1, are popular among a variety of users, including, for example, *cannabis* users. Smoking articles having a conical shape are typically hand-made, or otherwise produced in small, labor-intensive batches. In contrast, cylindrical smoking articles, such as traditional tobacco cigarettes, are often manufactured in high volume production systems with a high degree of sophisticated automation. But the difference in shape, among other reasons, can render the processes and apparatus of such automated systems inapplicable to conically shaped smoking articles such as the article 10.

Figure 2A:
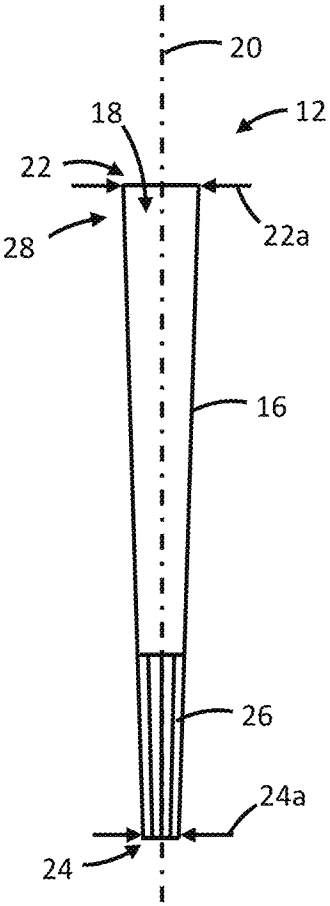
FIG. 2A is a cross-sectional view of the cone of FIG. 2, taken along line 2A-2A of FIG. 2.
Figure 2:
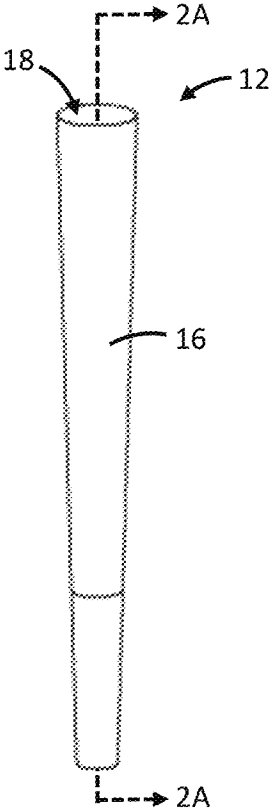
FIG. 2 is a perspective view of an example cone for manufacture of the smoking article of FIG. 1.

Referring to FIGS. 1 and 2, in the example illustrated, the example smoking article 10 is formed using a cone 12. The cone 12 is formed of a smokeable wrapper 16 having a cone cavity 18 for receiving and containing a smokeable product. In the example illustrated, the wrapper 16 is generally air impermeable, and the smokeable product is a granular product. In some examples, the cone 12 can be preassembled and the cone cavity 18 can be subsequently filled with the smokeable product. The smokeable product can be prepared via chopping, grinding, and/or sifting of a bulk smoking material. The bulk smoking material can include, for example, dried *cannabis* plant material, and the smokeable product can include *cannabis* granules.

Referring to FIG. 2A, in the example illustrated, the cone cavity 18 extends along a cone cavity axis 20 between an upper end 22 and a lower end 24 opposite the upper end 22. In the example illustrated, the wrapper 16 has an upper end diameter 22*a* at the upper end 22 of the cavity 18 and a lower end diameter 24*a* at the lower end 24 of the cavity 18. The lower end diameter 24*a* is smaller than the upper end diameter 22*a*, and the wrapper 16 tapers radially inwardly along the cavity axis 20 from the upper end diameter 22*a* to the lower end diameter 24*a* to provide the cone 12 with a generally conical shape. In the example illustrated in FIG. 2A, the upper end 22 of the cavity 18 is open for permitting filling of the cavity 18 with the smokeable product. In the example illustrated, the cone 12 includes a filter 26 in the cavity 18 adjacent the lower end 24. The filter 26 can help to provide structural stability to the smoking article 10, and can help inhibit smokeable product in the cavity 18 from escaping through the lower end 24.

Figure 3:
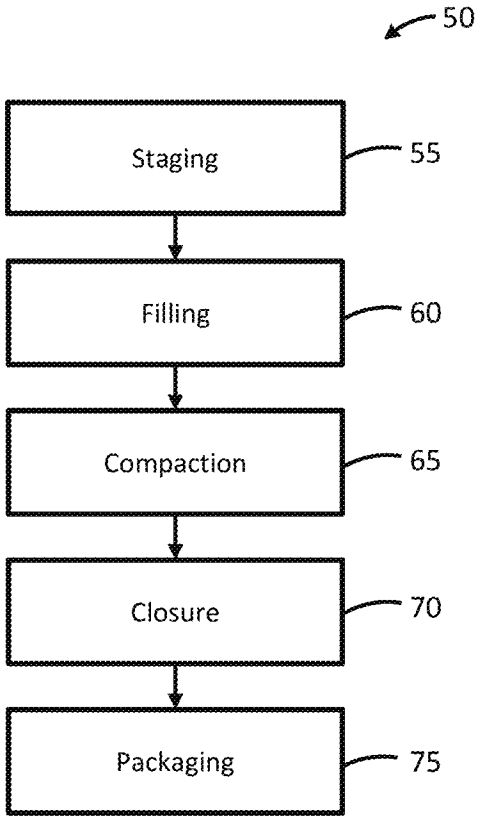
FIG. 3 is a flow chart showing an example process for production of conical smoking articles like that of FIG. 1.

Referring to FIG. 3, an example process 50 for production of conical smoking articles is shown, and will be described with respect to the example smoking article 10.

Figure 4:
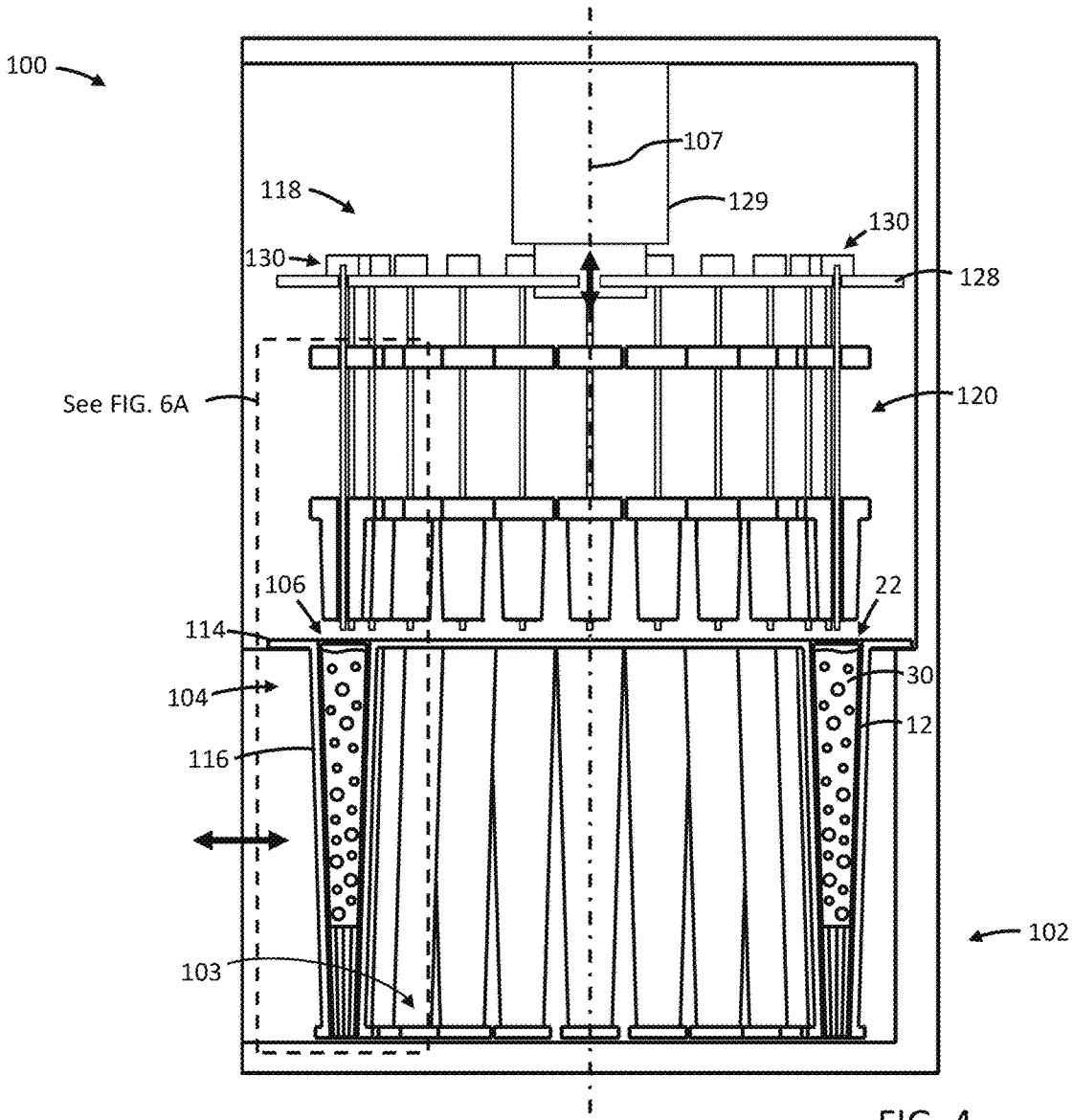
FIG. 4 is a schematic cross-sectional elevation view of an example compaction apparatus, showing a compaction mechanism of the apparatus in a retracted state.

At step 55 of the process 50, a plurality of the cones 12 are staged for filling with a smokeable product 30 (FIG. 4). The cones 12 can be staged by, for example, being positioned in a pallet with the open upper ends 22 directed upwardly for receiving the smokeable product.

At step 60, the staged cones 12 can be filled with the smokeable product 30 through respective open upper ends 22 of each cone 12. The cones 12 can be filled while held in the pallet.

At step 65, the smokeable product 30 in the cones 12 is compacted. The smokeable product 30 in the cones 12 can be compacted using compaction apparatuses and methods like those described in more detail below with respect to FIGS. 4 to 25. The smokeable product 30 can be compacted from, for example, a first height 32 (FIG. 6A) above the lower end 24 of the cone 12 to a second height 34 (FIG. 6C) above the lower end 24 of the cone 12 that is less than the first height 32. The smokeable product 30 can be compacted while the cones 12 are held in the pallet.

At step 70, an upper portion 28 of each wrapper 16 is twisted to close the upper end 22 of the cavity 18 for inhibiting the granule product from escaping from the cavity 18, and to form the smoking article 10. At step 75, the smoking articles 10 can be packaged for shipment and/or sale.

Referring to FIG. 4, an example compaction apparatus 100 for use during the compaction step 65 is shown, and will be described with respect to the example cone 12 of FIG. 2. In the example illustrated, the compaction apparatus 100 includes a frame 102 defining at least one station 103 for removably receiving a cone pallet 104.

In the example illustrated, the cone pallet 104 includes a plurality of pallet cavities 106. Each pallet cavity 106 holds a respective cone 12 filled with a volume of the smokeable product 30, and with the open upper end 22 of the cones 12 directed upwardly.

Figure 5:
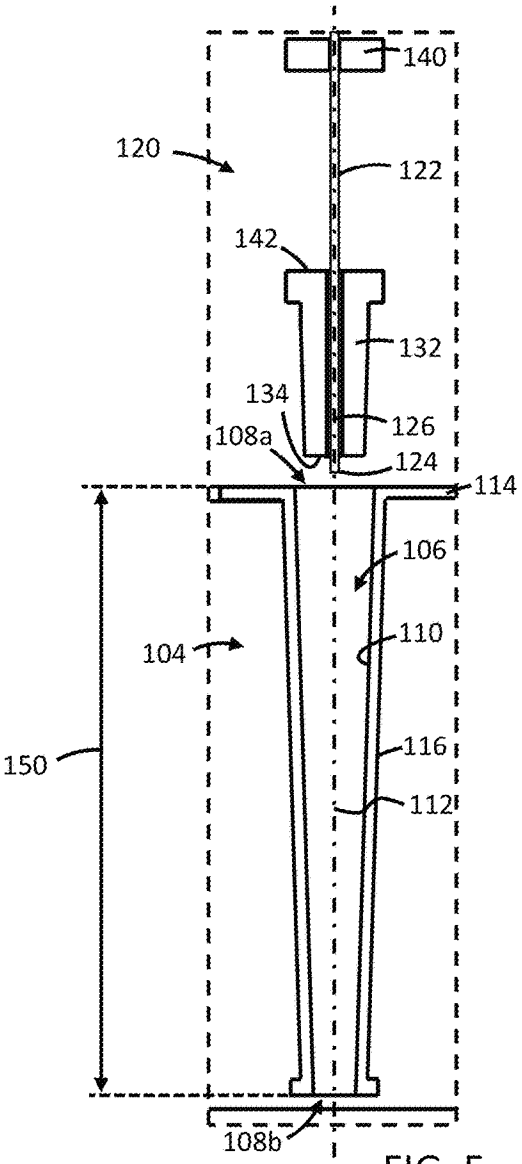
FIG. 5 is an enlarged view of a portion of FIG. 4, but with background structure and a cone removed.

Referring to FIG. 5, each pallet cavity 106 is defined by an inner surface 110 extending along a pallet cavity axis 112 between an open upper end 108*a* for receiving a cone 12 and a lower end 108*b* opposite the upper end 108*a*. In the example illustrated, the inner surface 110 tapers radially inwardly along the axis 112 from the upper end 108*a* toward the lower end 108*b* to provide the inner surface 110 with a generally conical shape corresponding to that of at least a portion of the cone 12. In the example illustrated, the pallet 104 has a pallet body 114, and the pallet cavities 106 are provided in respective nests 116 attached to the pallet body 114.

Referring to FIG. 4, in the example illustrated, the apparatus 100 further includes a compaction mechanism 118 positionable above the cone pallet 104 when the cone pallet 104 is received in the station 103. In the example illustrated, the compaction mechanism 118 is supported by the frame 102. The compaction mechanism 118 includes at least one pin assembly 120 for inducing compaction of smokeable product 30 held in a respective cone 12. In the example illustrated, the compaction mechanism 118 includes a plurality of the pin assemblies 120, with each pin assembly 120 aligned above the open upper end 22 of a respective cone 12. In the example illustrated, the quantity of pin assemblies 120 is equal to the quantity of pallet cavities 106 (and cones 12). In the example illustrated, the compaction mechanism 118 includes twenty-four (24) pin assemblies 120 and the pallet includes twenty-four (24) pallet cavities 106. In some examples, the compaction mechanism 118 can include a different quantity of pin assemblies 120 such as, for example, fifty-four (54) pin assemblies 120, and the pallet 104 can include fifty-four (54) pallet cavities 106 (and cones 12). In the example illustrated, each of the plurality of pin assemblies 120 and the plurality of pallet cavities 106 are arranged in a circular array about a vertical axis 107.

Figure 6A:
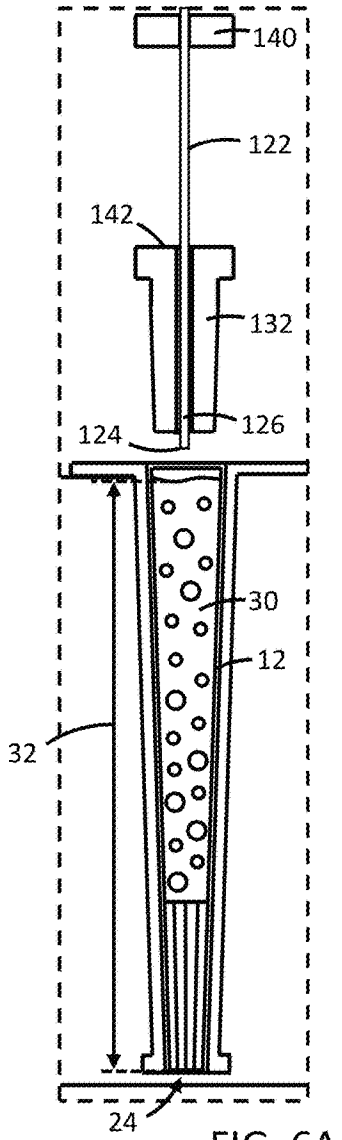
FIG. 6A is an enlarged view like that of FIG. 5, but showing the cone held in a pallet cavity of the apparatus of FIG. 4.
Figure 6C:
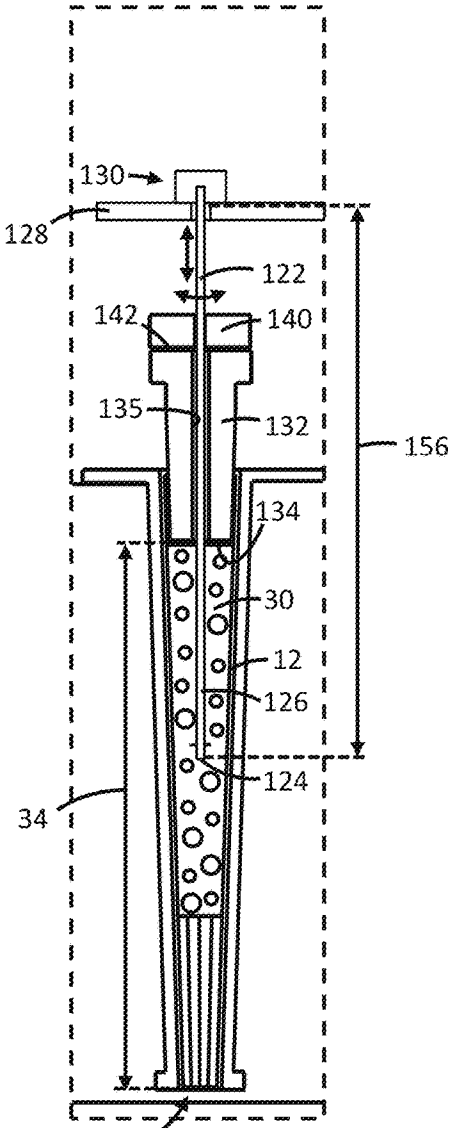
FIG. 6C is an enlarged view like that of FIG. 6B, but showing a portion of the compaction mechanism in an advanced state.

Referring to FIG. 5, in the example illustrated, each pin assembly 120 includes a pin 122 extending along a pin axis and alignable with the open upper end 22 of a respective cone 12 (and with the open upper end 108*a* of a respective cavity 106). The pin axis is oriented vertically and generally coaxial with the pallet cavity axis 112 in the example of FIG. 5. When aligned, the pin 122 is movable vertically relative to the cone pallet 104 from a pin retracted position distal the cone pallet 104 (shown in FIGS. 5 and 6A) toward a pin advanced position proximate the cone pallet 104 (shown in FIG. 6C). Referring to FIG. 6A, when the pin 122 is in the pin retracted position, the pin 122 is spaced apart from the smokeable product 30 in a cone 12 held in a respective cavity 106. In the example illustrated, when the pin 122 is in the pin retracted position, a pin tip 124 of the pin 122 is spaced above the smokeable product 30 and the pallet 104. Referring to FIG. 6C, the pin 122 is movable toward the pin advanced position for inserting a lower portion 126 of the pin 122 into a volume of the smokeable product 30 in the cone 12 held in the pallet cavity 106.

Referring to FIG. 4, in the example illustrated, the pin assemblies 120 are supported by and extend downwardly from a pin carrier 128. In the example illustrated, the pin carrier 128 is coupled to the frame 102 via a linear actuator 129 operable to vertically translate the pin carrier 128 along the axis 107 to move the pins 122 between the pin retracted and advanced positions. In some examples, the pin carrier 128 can be fixed relative to the frame 102, and the cone pallet 104 can be raised relative to the frame 102 toward the pin carrier 128 to advance the pins 122 toward the advanced position. In some examples, both the pin carrier and the pallet 104 can be movable relative to the frame 102 and translated toward one another to advance the pins 122 toward the advanced position.

In the example illustrated, the compaction mechanism 118 includes one or more vibratory drives 130 coupled to the pins 122. In the example illustrated, each pin 122 is shown coupled to a respective vibratory drive 130. In some examples, one vibratory drive 130 may be provided for vibrating a plurality of the pins 122.

Referring to FIG. 6C, the vibratory drive 130 is operable to vibrate a respective pin 122. In the example illustrated, the drive 130 is operable to vibrate the pin 122 at least when the pin 122 is in the advanced position (i.e. when the lower portion 126 of the pin 122 is within the volume of the smokeable product 30 of a respective cone 12) for inducing settlement of the smokeable product 30. The vibratory drive 130 can be operable to oscillate the pin 122 to drive vibration thereof. For example, the vibratory drive can be operable to oscillate the pin 122 about and/or along a vertical axis (e.g. the pin axis and/or the pallet cavity axis 112) to vibrate the pin 122, and/or the vibratory drive 130 can be operable to oscillate the pin 122 about and/or along a horizontal axis. In the example illustrated, the vibratory drive 130 is tunable to adjust at least one of a vibration frequency and a vibration amplitude for vibrating the pin 122.

Figure 6B:
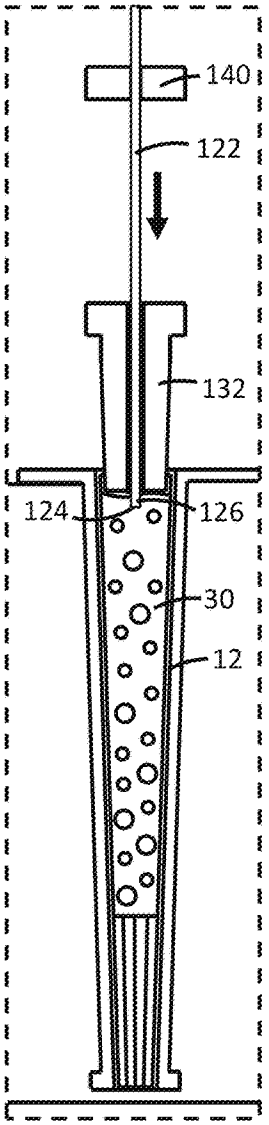
FIG. 6B is an enlarged view like that of FIG. 6A, but showing a portion of the compaction mechanism in an intermediate state.

Referring to FIGS. 6B and 6C, in the example illustrated, each pin assembly 120 includes a collar 132 positionable in the open upper end 22 (FIG. 2A) of a respective cone 12 atop the smokeable product 30 for generally covering the open upper end 22 when the pin 122 is in the pin advanced position. Referring to FIG. 6C, in the example illustrated, the collar 132 includes a front face 134 for bearing against an upper surface of the smokeable product 30 in the respective cone 12, and an interior aperture 135 for slidably receiving the pin 122 therethrough. Referring to FIGS. 6B and 6C, when the collar 132 is positioned atop the smokeable product 30, the pin 122 is translatable relative to the collar 132 during movement toward the pin advanced position. In the example illustrated, the collar 132 can exert a compressive force against the smokeable product 30. In the example illustrated, the collar 132 can be urged downwardly to exert the compressive force.

Figure 7A:
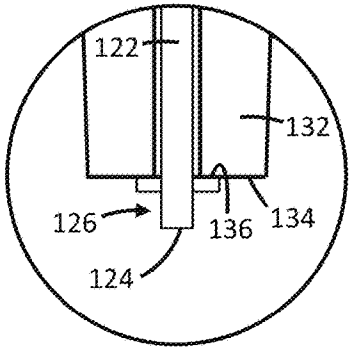
FIG. 7A is an enlarged view of a lower portion of a pin assembly of the apparatus of FIG. 4, showing a portion of a collar of the pin assembly in engagement with a catch of the pin assembly.
Figure 7B:
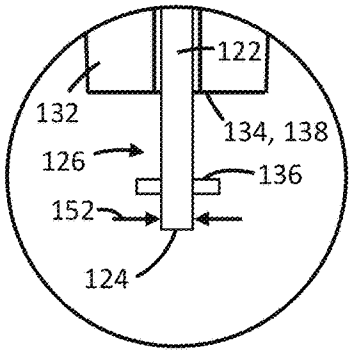
FIG. 7B is an enlarged view like that of FIG. 7A, but showing the collar spaced vertically apart from the catch.

Referring to FIGS. 7A and 7B, in some examples, the pin assembly 120 can include a catch 136 attached to the lower portion 126 of the pin 122 for engagement with an engagement surface 138 (FIG. 7B) of the collar 132 above the catch 136 for limiting downward movement of the collar 132. In the example illustrated, when the pin 122 is in the pin retracted position, the catch 136 is above the smokeable product 30 (and the pallet cavity 106) and is engagement with the engagement surface 138 of the collar 132 to inhibit the collar 132 from sliding off the pin 122. When the pin 122 is in the pin advanced position, the catch 136 is positioned in the smokeable product 30, and the engagement surface 138 of the collar 132 is above the smokeable product 30 and spaced vertically apart from (above) the catch 136.

The catch 136 can comprise, for example, a projection extending radially outwardly from an outer surface of the pin 122, and can be sized to reduce interference with advancement and retraction of the pin 122 into and out from the smokeable product 30, while still ensuring sufficient engagement with the collar 132 for raising the collar 132 when the pin 122 moves to the pin retracted position. In the example illustrated, the engagement surface 138 comprises the front face 134 of the collar 132. In some examples, the catch 136 may be omitted. For example, the collar 132 may be moved via an actuator relative to the pin, may be engageable with a catch fixed relative to the pin carrier 128, and/or manually positioned atop the smokeable product 30 and the pin 122 may be subsequently advanced through the collar 132 and into the smokeable product 30.

Referring to FIG. 6A, in the example illustrated, each pin assembly 120 includes a plunger 140 attached to the pin 122 above a rear face 142 of the collar 132 that is opposite the front face 134. In the example illustrated, the plunger 140 is spaced apart from the rear face 142 of the collar 132 when the pin 122 is in the pin retracted position. Referring to FIG. 6C, the plunger 140 can bear against the rear face 142 of the collar 132 when the pin 122 is in the pin advanced position for pushing the collar 132 downwardly to exert the compressive force. In the example illustrated, the collar 132 is formed of a generally rigid material (e.g. metal or plastic), and the plunger 140 is formed of a generally elastic material (e.g. rubber). In some examples, the plunger can be formed from an easily cleanable and hard material, such as stainless steel or aluminum.

Referring to FIG. 5, in the example illustrated, each pallet cavity 106 has a cavity height 150 between the upper end 108*a* and the lower end 108*b* of the pallet cavity 106. Referring to FIG. 6C, in the example illustrated, the pin 122 advances through at least 20% of the cavity height 150 when moving toward the pin advanced position. In some examples, the pin may be advanced through at least 50% of the cavity height 150 when moving toward the pin advanced position.

Referring to FIG. 7B, in the example illustrated, the pin has a pin outer diameter 152, and in some examples, the pin outer diameter 152 can be, for example, greater than 1.1 mm. In some examples, the pin outer diameter 152 can be greater than 1.3 mm. Referring to FIG. 6C, in the example illustrated, the pin 122 has a pin length 154 between the pin tip 124 and an anchor end opposite the pin tip 124, and in some examples, the pin length 154 can be, for example, at least 100 mm. In some examples, the pin length can be about 122 mm and the outer diameter can be about 1.35 mm. The pin outer diameter 152 and/or the pin length 154 may be selected based on, for example, the dimensions of the cones 12 and/or the pallet cavities 106 and/or the compacting characteristic of the selected smokeable material used to fill the cones.

Figure 8:
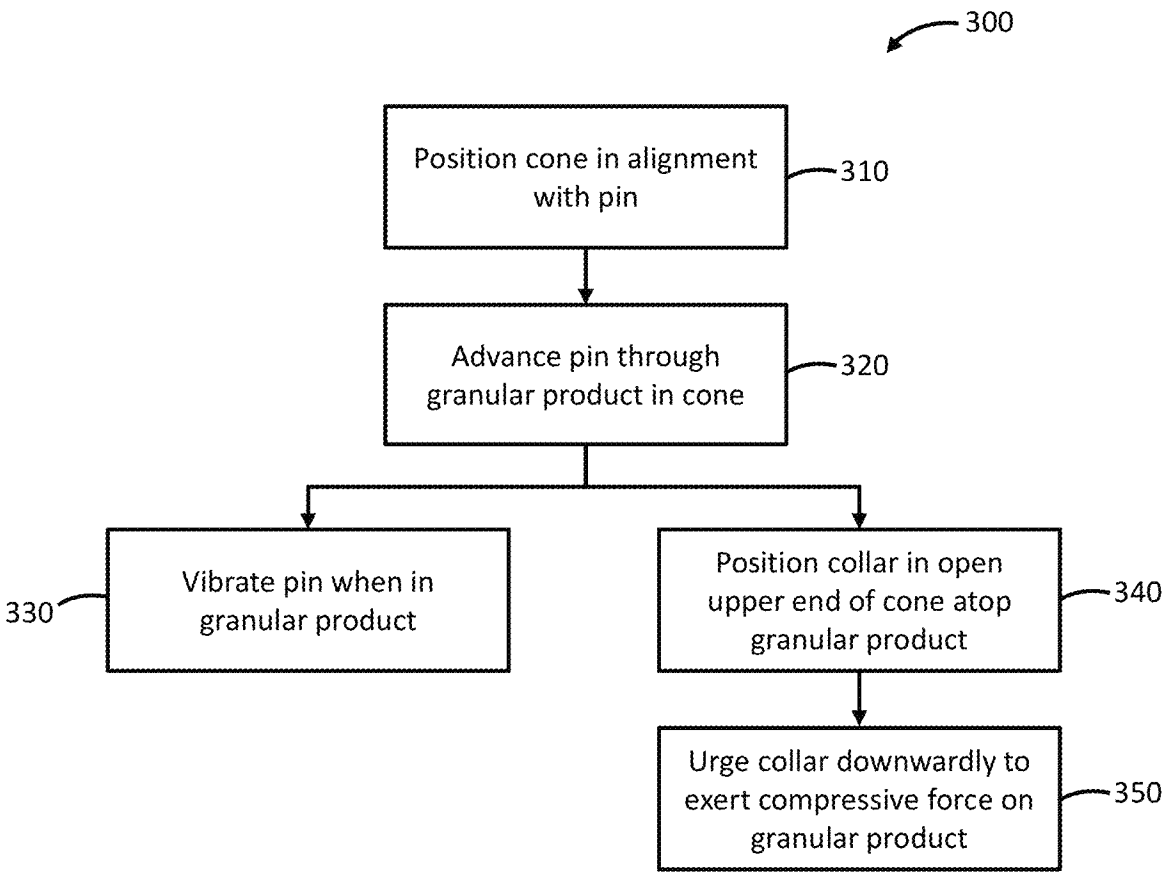
FIG. 8 is a flow chart showing an example process for production of conical smoking articles using an apparatus like that of FIG. 4.

Referring to FIG. 8, an example process 300 for production of smoking articles using a compaction apparatus similar to the compaction apparatuses of the present specification is shown, and will be described with respect to compaction apparatus 100. At step 310 of the process 300, a respective cone 12 received in the cone pallet 104 and holding a volume of the smokeable product 30 is positioned in alignment with a respective pin 122. At step 320, the pin 122 is advanced into the volume of the smokeable product 30 through the open upper end 22 of the cone 12. At step 330, when the pin 122 is in the volume of the smokeable product 30, the pin is vibrated to induce settlement of the smokeable product 30. The pin 122 can be vibrated while being advanced through the smokeable product 30, while being withdrawn from the smokeable product 30, and/or while in a pin advanced position in the smokeable product 30. In some examples, the pin 122 can be vibrated for at least 8 seconds when in the smokeable product 30.

At step 340, the collar 132 is positioned in the open upper end 22 of the cone 12 atop the smokeable product 30, and at step 350, the collar 132 is urged downwardly to exert a compressive force on the smokeable product 30. The collar can be urged downwardly via the plunger 340. In some examples, the collar 132 can exert the compressive force via gravitational force. In some examples, the compressive force is exerted for at least 8 seconds.

During the process 300, steps 330 and 350 can be performed simultaneously.

Step 320 can further include advancing the pin 122 through the collar 132 while the collar 132 is atop the smokeable product 30. In some examples, the process 300 can further include withdrawing the pin 122 from the smokeable product 30 while the collar 132 is atop the smokeable product 30.

The process 300 can further include tuning at least one of a vibration frequency and a vibration amplitude for vibrating the pin.

Figure 22B:
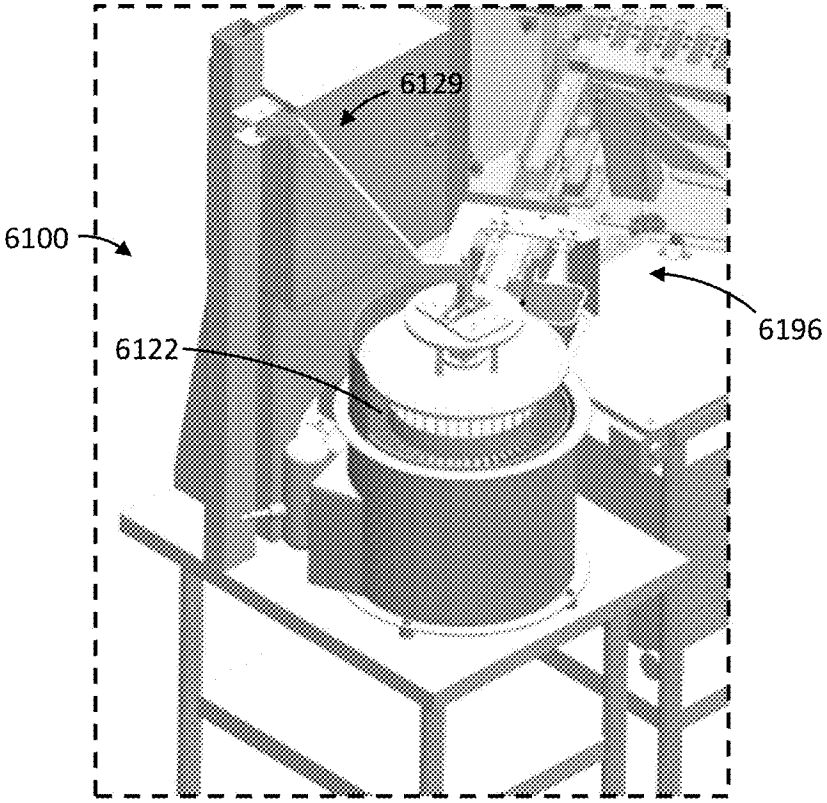
FIG. 22B is another perspective view of the apparatus of FIG. 22A, showing a pin portion in a second configuration.
Figure 22A:
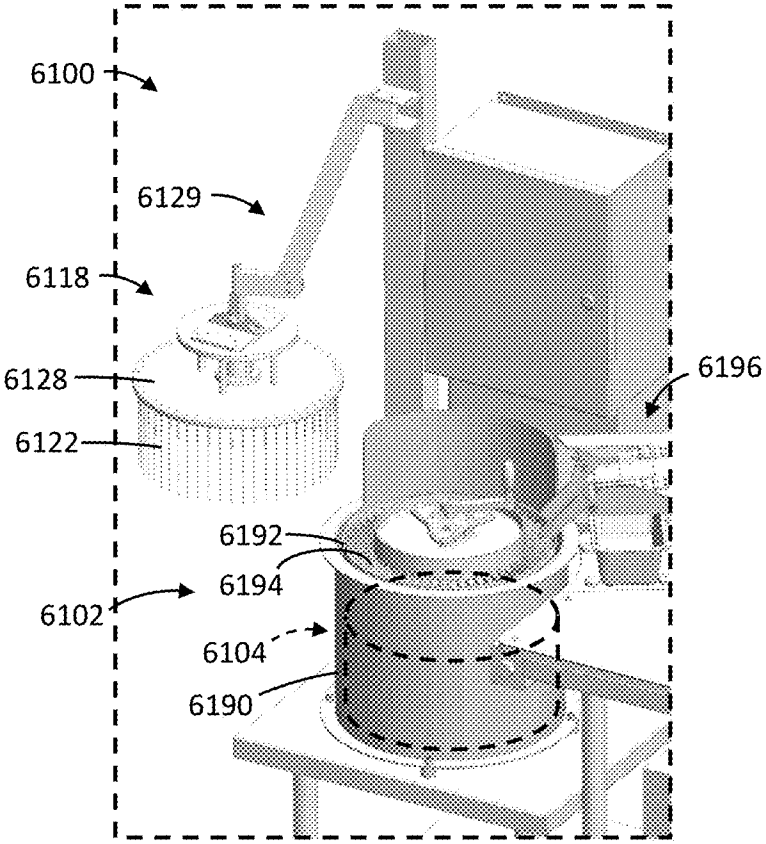
FIG. 22A is a perspective view of another example compaction apparatus, showing a pin portion in a first configuration.

In some examples, prior to step 310 of the process 300, the pallet 104 can be positioned at a cone staging station to facilitate the staging step 55 of the process 50 (FIG. 3). At the cone staging station, a cone 12 is transferred into each empty pallet cavity 106 of the pallet 104. After each cavity 106 of the pallet 104 has received a respective cone 12, the pallet 104 can be moved from the cone staging station to a cone filling station to facilitate the filling step 60 of the process 50 (FIG. 3). At the cone filling station, each cone 12 can be filled with the smokeable product 30. After each cone 12 is filled, the smokeable product 30 in the cones 12 can be compacted. In some examples, after each cone 12 is filled, the pallet 104 holding the filled cones can be moved to a cone compaction station for compacting the smokeable product 30 in the cones 12 using, for example, the apparatuses and processes disclosed herein (e.g. the apparatus 100 and process 300). In some examples, after each cone 12 is filled, the cone pallet can remain at the filling station, and the smokeable product 30 can be compacted at the filling station using a compaction apparatus such as, for example, the apparatus 6100 (FIGS. 22A and 22B).

After the smokeable product in each cone 12 is compacted, the pallet 104 can be moved from under the compaction mechanism 118, and another pallet 104 holding filled cones 12 with loose smokeable product can be positioned under the compaction mechanism 118 for compaction of smokeable product.

After the smokeable product in a pallet 104 is compacted, the pallet 104 can be moved to a cone closure station to facilitate the closing step 70 of the process 50 (FIG. 3). At the cone closure station, an upper portion of each cone 12 is twisted to close the open upper end 22 of each cone 12.

Figure 9A:
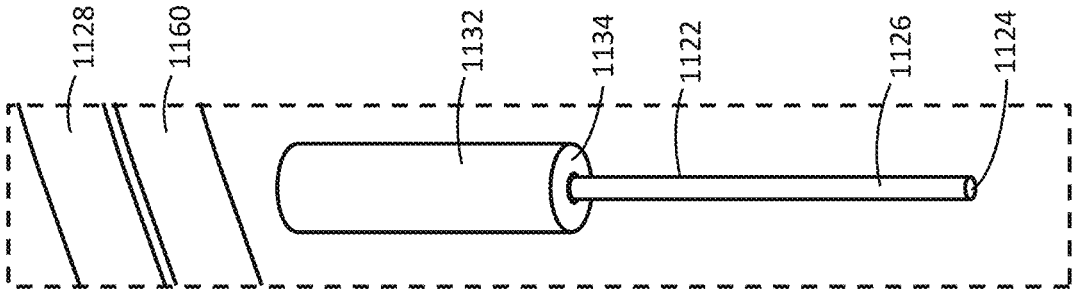
FIG. 9A is a perspective view from below of a portion of the compaction apparatus of FIG. 9.
Figure 9:
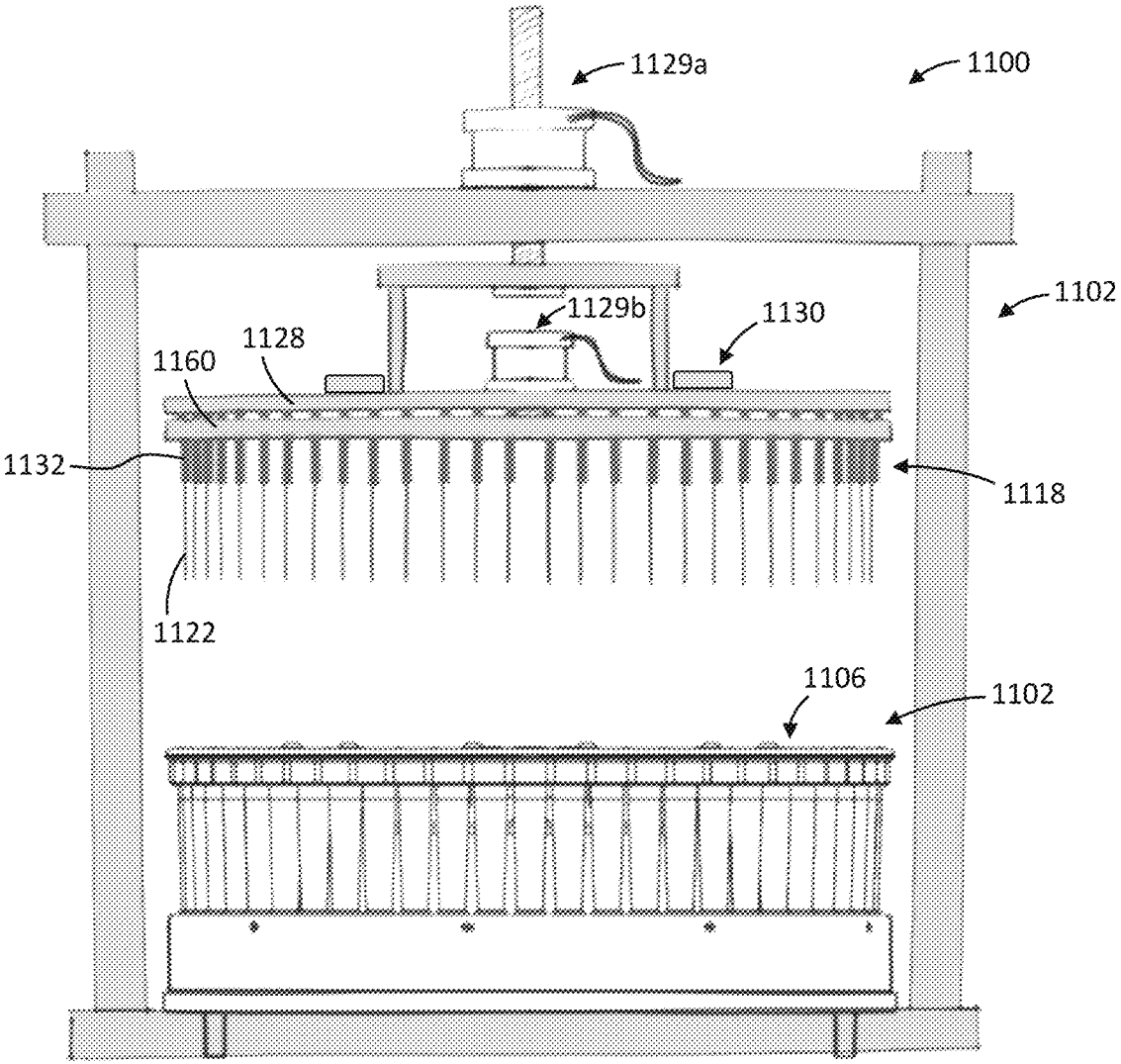
FIG. 9 is a schematic side elevation view of another example compaction apparatus, showing a pin portion of the apparatus in a retracted configuration and a tamper portion of the apparatus in a rearward configuration.

Referring to FIG. 9, another example compaction apparatus 1100 is shown. The compaction apparatus 1100 has similarities to the apparatus 100, and like features are identified with like reference characters, incremented by 1000. In the example illustrated, the compaction apparatus 1100 includes a frame 1102 for removably receiving a cone pallet 1104. The cone pallet 1104 includes a plurality of pallet cavities 1106. Each cavity 1106 holds a respective cone 12 filled with a volume of smokeable product 30 (FIG. 11A).

In the example illustrated, the apparatus 1100 includes a compaction mechanism 1118 positionable above the cone pallet 1104. The compaction mechanism 1118 can be used to compact the volume of the smokeable product 30 from a first height 32 (FIG. 11A) above the lower end 24 of the cone 12 to a second height 34 (FIG. 11C) above the lower end 24 of the cone 12 that is less than the first height 32.

Figure 11D:
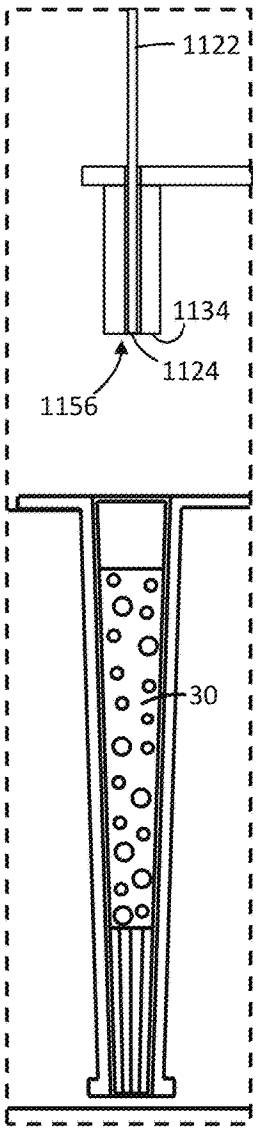
FIG. 11D is a schematic view like that of FIG. 11A, and showing the pin portion and the tamping portion forming a tamping face in a retracted configuration.
Figure 11C:
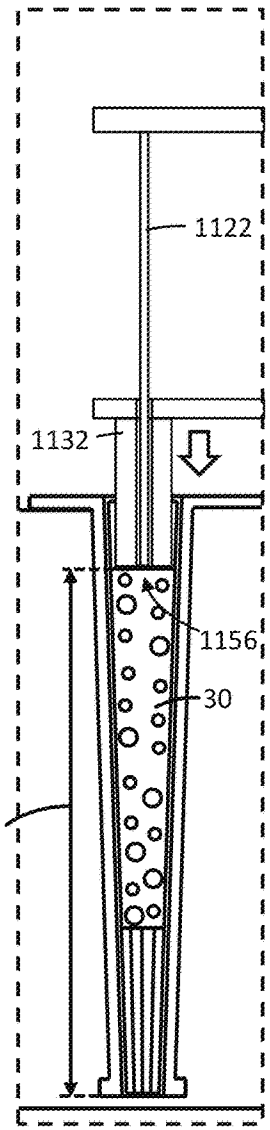
FIG. 11C is a schematic view like that of FIG. 11A, and showing the pin portion and the tamping portion forming a tamping face in an advanced configuration.
Figure 11B:
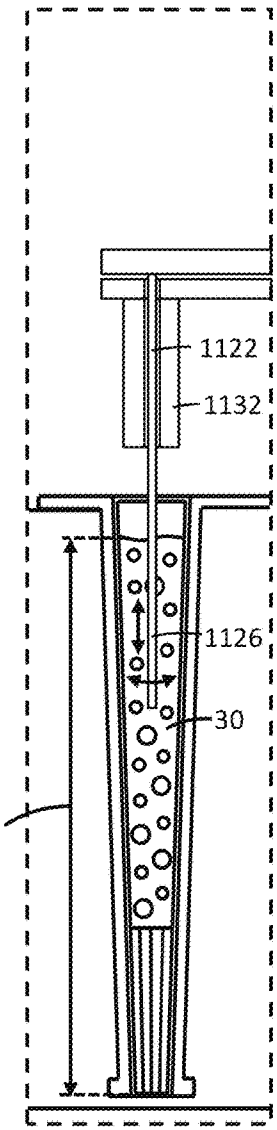
FIG. 11B is a schematic view like that of FIG. 11A, and showing the pin portion in an advanced configuration and the tamping portion in a rearward configuration.
Figure 11A:
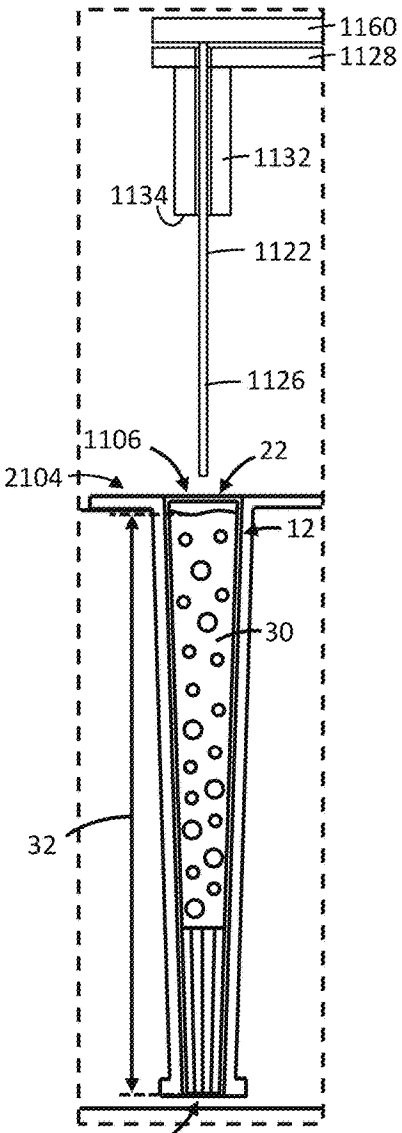
FIG. 11A is a schematic cross-sectional elevation view of a portion of the compaction apparatus of FIG. 9, showing the pin portion in a retracted configuration and the tamper portion in a rearward configuration.

Referring to FIG. 11A, the compaction mechanism 1118 includes at least one pin 1122 extending along a pin axis and alignable with an open upper end 22 of a respective cone 12 held in a respective cavity 1106. When aligned, the at least one pin 1122 is movable vertically relative to the cone pallet 1104 from a pin retracted position (FIG. 11A) distal the cone pallet 1104, toward a pin advanced position (FIG. 11B) proximate the cone pallet 1104 for inserting a lower portion 1126 of the pin 1122 into the volume of the smokeable product 30 in the respective cone 12.

Referring to FIG. 9, in the example illustrated, the compaction mechanism 1118 further includes at least one vibratory drive 1130 coupled to the pins 1122. The vibratory drive 1130 is operable to vibrate the pins 1122 when the lower portion 1126 of the pins 1122 is within the volume of the smokeable product 30 of respective cones 12. This can help induce settlement of the volume of the smokeable product 30 from the first height 32 (FIG. 11A) to an intermediate height 33 (FIG. 11B) above the lower end 24 of the cone 12 that is intermediate the first height 32 and the second height 34 (FIG. 11C).

Figure 10A:
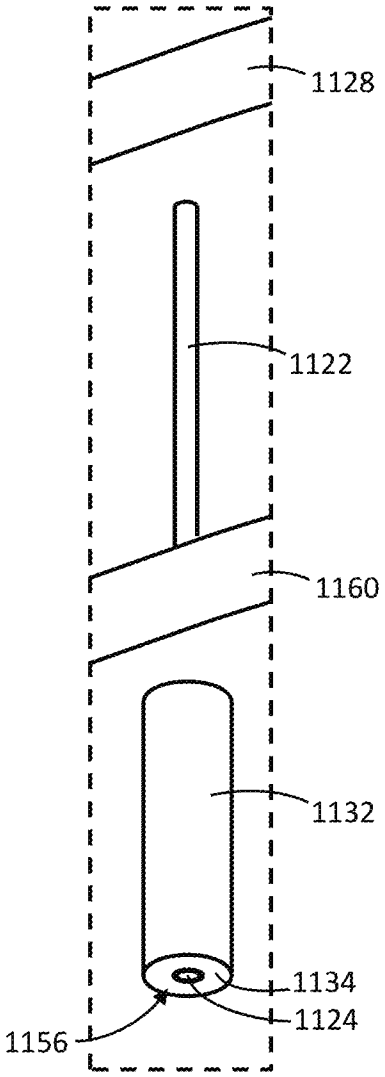
FIG. 10A is a schematic perspective view from below of a portion of the compaction apparatus of FIG. 10.

Referring to FIGS. 9 and 9A, in the example illustrated, the compaction mechanism 1118 further includes at least one tamping collar 1132 having an annular front face 1134 directed toward the cone pallet 1104 and an interior aperture open to the front face 1134 and receiving a respective pin 1122. In the example illustrated, the collar 1132 is axially movable relative to the pin 1122 between a collar rearward position (shown in FIGS. 9 and 9A) and a collar forward position (shown in FIGS. 10 and 10A). Referring to FIGS. 11A and 11B, when the collar is in the rearward position, the lower portion 1126 of the pin 1122 projects downwardly from the front face 1134 of the collar 1132 to facilitate movement of the pin toward the pin advanced position (FIG. 11B). Referring to FIG. 10A, when the collar 1132 is in the forward position, the annular front face 1134 of the collar 1132 and a tip 1124 of the pin 1122 form a tamping face 1156. With this configuration, in the 11B state where the Pin 1122 is in an advanced position relative to the collar 1132 for doing Pin compaction, both 1122 and 1132 can have a fixed relative position to one another during the plunging and retraction phase, thus limiting wear between the external face of pin 1132 and the internal bore surface of Collar 1132. Wearing is decreased by urging the two relatively fixed elements together during the pin compaction as opposed to moving the pin down/plunge and up/retract through a static non-moving collar. Referring to FIG. 11C, the tamping face 1156 is moveable toward a tamping advanced position proximate the cone pallet 1104 to urge the tamping face 1156 downwardly against an upper surface of the smokeable product 30 to exert a compressive force thereon. This can facilitate compaction of the volume of the smokeable product 30 from the intermediate height 33 (FIG. 11B) to the second height (FIG. 11C).

Referring to FIG. 11D, the tamping face 1156 is movable from the tamping advanced position to a tamping retracted position distal the cone pallet 1104, and in which the tamping face 1156 is spaced apart from the volume of the smokeable product 30. In the example illustrated, the annular front face 1134 of the collar and the tip 1124 of the pin 1122 are generally flush when the collar is in the forward position.

Referring to FIG. 9, in the example illustrated, the compaction mechanism 1118 includes a pin carrier 1128 supported by the frame 1102 and holding the at least one pin 1122. In the example illustrated, the compaction mechanism 1118 includes a first actuator 1129*a* operable to translate the at least one pin 1122 between the pin advanced and retracted positions. In the example illustrated, the first actuator 1129*a* is operable to translate the pin carrier 1128 relative to the cone pallet 1104 for translating the pin 1122. In the example illustrated, the first actuator 1129*a* extends between the frame 1102 and the pin carrier 1128 for translating the pin carrier 1128 relative to the frame 1102.

Figure 10:
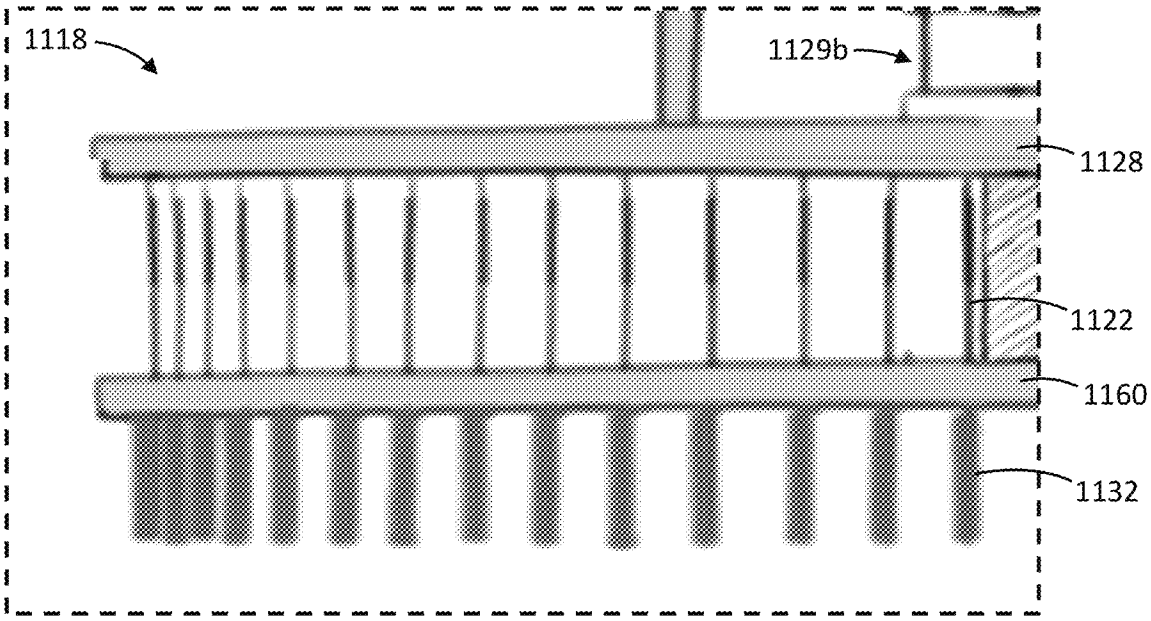
FIG. 10 is an enlarged view of a portion of the compaction apparatus of FIG. 9, and showing the pin portion in a retracted configuration and the tamper portion in a forward configuration.

Referring to FIGS. 9 and 10, the compaction mechanism 1118 further includes a tamper carrier 1160 supported by the frame 1102 and holding the at least one tamping collar 1132. In the example illustrated, the compaction mechanism 1118 includes a second actuator 1129*b* operable to move the at least one tamping collar 1132 between the rearward and forward positions. In the example illustrated, the second actuator 1129*b* is operable to translate the tamper carrier 1160 relative to the pin carrier 1128 for moving the at least one collar 1132 between the rearward and forward positions. In the example illustrated, the tamper carrier 1160 is releasably fixable in position relative to the pin carrier 1128 when the collar 1132 is in the forward position.

In the example illustrated, the tamper carrier 1160 and the second actuator 1129*b* are supported by the pin carrier 1128, and the first actuator 1129*a* is operable to move the pin carrier 1128, the tamper carrier 1160, and the second actuator 1129*b* relative to the cone pallet 1104. When the tamping collar 1132 is in the forward position, the first actuator 1129*a* is operable to move the tamping face 1156 toward the tamping advanced position.

In the example illustrated, the compaction mechanism 1118 includes a plurality of the pins 1122, with each pin 1122 in alignment with the open upper end 22 of a respective cone 12 (and with the open upper end of a respective cavity 1106 holding the cone 12). In the example illustrated, each of the pins 1122 is held by the pin carrier 1128.

In the example illustrated, the compaction mechanism 1118 includes a plurality of the tamping collars 1132, with each tamping collar 1132 receiving a respective pin 1122. In the example illustrated, each of the tamping collars 1132 is held by the tamper carrier 1160. In the example illustrated, the quantity of the tamping collars 1132, the quantity of the pins 1122, and the quantity of the cones 12 (and pallet cavities 1106) is equal.

Figure 12:
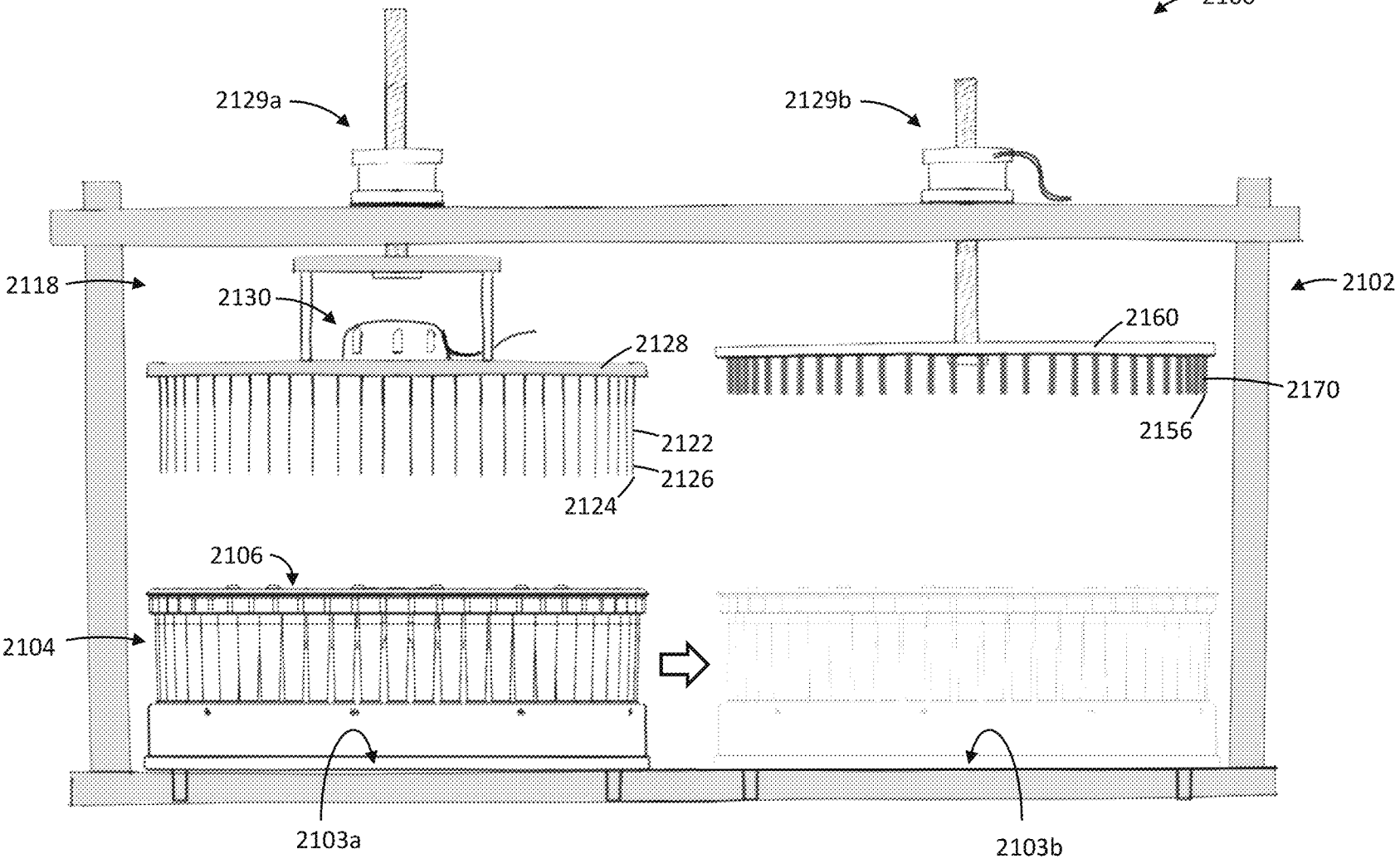
FIG. 12 is a schematic side elevation view of another example compaction apparatus.

Referring to FIG. 12, another example compaction apparatus 2100 is shown. The compaction apparatus 2100 has similarities to the apparatus 1100, and like features are identified with like reference characters, incremented by 1000.

Figure 13B:
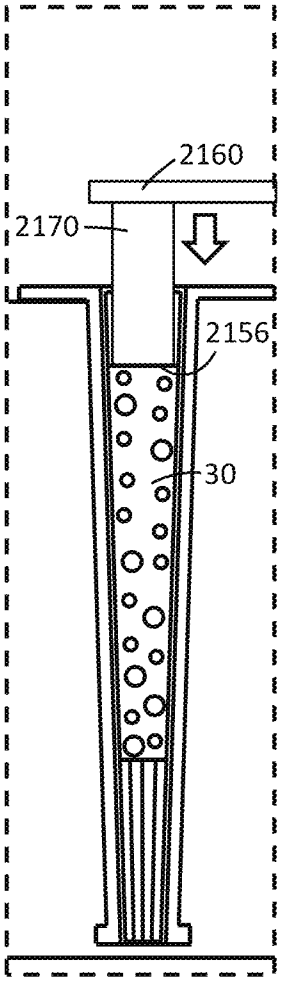
FIG. 13B is a schematic view like that of FIG. 13A, and showing the tamping portion in an advanced configuration.
Figure 13A:
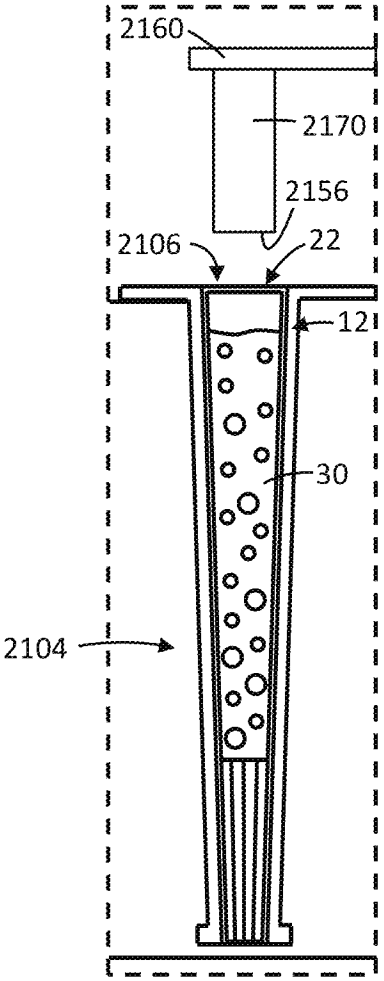
FIG. 13A is a schematic cross-sectional elevation view of a portion of the compaction apparatus of FIG. 12, showing a tamping portion of the apparatus in a retracted configuration.

In the example illustrated, the compaction apparatus 2100 includes a frame 2102 for removably receiving a cone pallet 2104. The cone pallet 2104 includes a plurality of pallet cavities 2106. Referring to FIG. 13A, each cavity 2106 holds a respective cone 12 filled with a volume of smokeable product 30. Referring to FIG. 12, in the example illustrated, the apparatus 2100 includes a compaction mechanism 2118 positionable above the cone pallet 2104. The compaction mechanism 2118 includes at least one pin 2122 alignable with the open upper end of a respective cone 12 (and with the cavity 2106). When aligned, the pin 2122 is movable vertically relative to the cone pallet 2104 from a pin retracted position toward a pin advanced position. In the example illustrated, the compaction mechanism 2118 further includes at least one vibratory drive 2130 operable to vibrate the at least one pin 2122.

In the example illustrated, the compaction mechanism 2118 includes at least one tamping rod 2170 spaced apart from the pin 2122 and having a tamping face 2156 alignable with the open upper end 22 of the respective cone 12 (and with the pallet cavity 2106). Referring to FIGS. 13A and 13B, when aligned, the tamping face 2156 is movable relative to the cone pallet 2104 between a tamping retracted position (FIG. 13A) distal the cone pallet 2104 and a tamping advanced position (FIG. 13B) proximate the cone pallet 2104. When in the tamping retracted position, the tamping face 2156 is spaced apart from the smokeable product 30 in the respective cone 12 (and from the pallet cavity 2106). The tamping face 2156 is moveable toward to the tamping advanced position to urge the tamping face 2156 downwardly against an upper surface of the smokeable product 30 in the cone 12 to exert a compressive force thereon. In the example illustrated, the pin 2122 has a tip 2124 (FIG. 12) having a pin tip diameter, and the tamping face 2156 has a tamping face diameter that is greater than the pin tip diameter.

Referring to FIG. 12, in the example illustrated, the frame 2102 defines a first station 2103*a* below the at least one pin 2122 and a second station 2103*b* below the at least one tamping rod 2170 and spaced horizontally apart from the first station 2103*a*. In the example illustrated, the cone pallet 2104 is moveable relative to the frame 2102 between the first station 2103*a* and the second station 2103*b*. When the cone pallet 2104 is in the first station 2103*a*, the at least one pin 2122 is in alignment with the open upper end 22 of a respective cone 12 (and with a respective pallet cavity 2106), and the pin 2122 is movable toward the pin advanced position for insertion of the lower portion 2126 into the volume of the smokeable product 30. When the cone pallet 2104 is in the second station 2103*b*, the tamping face 2156 of the at least one rod 2170 is in alignment with the open upper end 22 of the cone 12 (and with a respective pallet cavity 2106), and the tamping face 2156 is movable toward the tamping advanced position to exert the compressive force on the upper surface of the smokeable product 30.

In the example illustrated, the compaction mechanism 2118 includes a plurality of the pins 2122 held by a pin carrier 2128. When the cone pallet 2104 is in the first station 2103*a*, each pin 2122 is in alignment with the open upper end 22 of a respective cone 12 (and with a respective cavity 2106). In the example illustrated, the quantity of pins 2122 is equal to the quantity of cones 12 (and pallet cavities 2106). In the example illustrated, the compaction mechanism 2118 includes a first actuator 2129*a* operable to translate the at least one pin 2122 between the pin advanced and retracted positions. In the example illustrated, the first actuator 2129*a* is operable to translate the pin carrier 2128 relative to the cone pallet 2104 for translating the pin 2122.

In the example illustrated, the compaction mechanism 2118 includes a plurality of the tamping rods 2170 held by a tamper carrier 2160. When the cone pallet 2104 is in the second station 2103*b*, each tamping face 2156 is in alignment with the open upper end 22 of a respective cone 12 (and with a respective pallet cavity 2106). In the example illustrated, the quantity of tamping rods 2170 is equal to the quantity of cones 12 (and pallet cavities 2106). In the example illustrated, the compaction mechanism 2118 includes a second actuator 2129*b* operable to translate the tamping faces 2156 between the tamping advanced and retracted positions. In the example illustrated, the second actuator 2129*b* is operable to translate the tamper carrier 2160 relative to the cone pallet 2104 for translating the tamping faces 2156.

Figure 14:
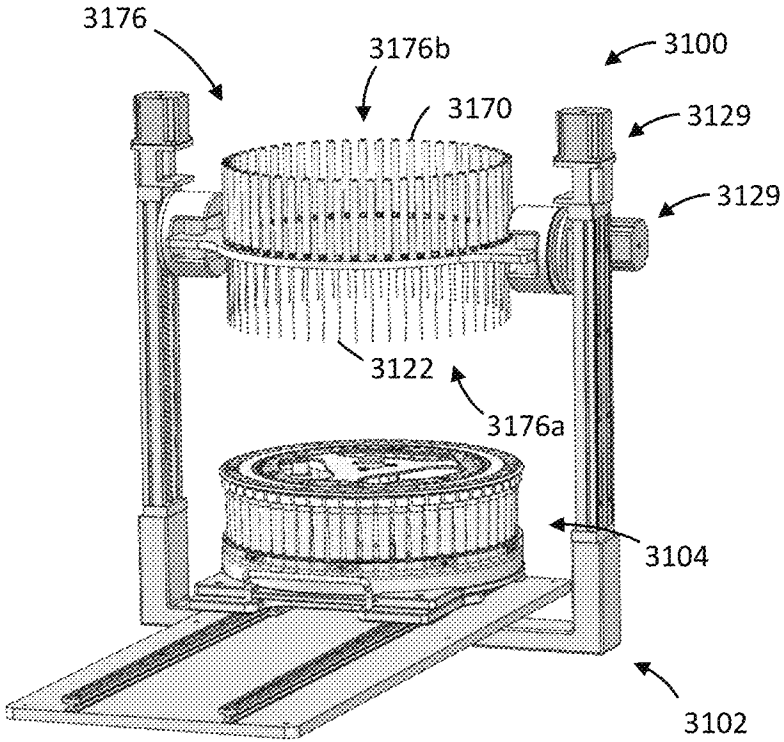
FIG. 14 is a perspective view of another example compaction apparatus, showing a rotatable carriage of the apparatus raised and in a first configuration.

Referring to FIG. 14, another example compaction apparatus 3100 is shown. The compaction apparatus 3100 has similarities to the apparatus 2100, and like features are identified with like reference characters, incremented by 1000.

Figure 15:
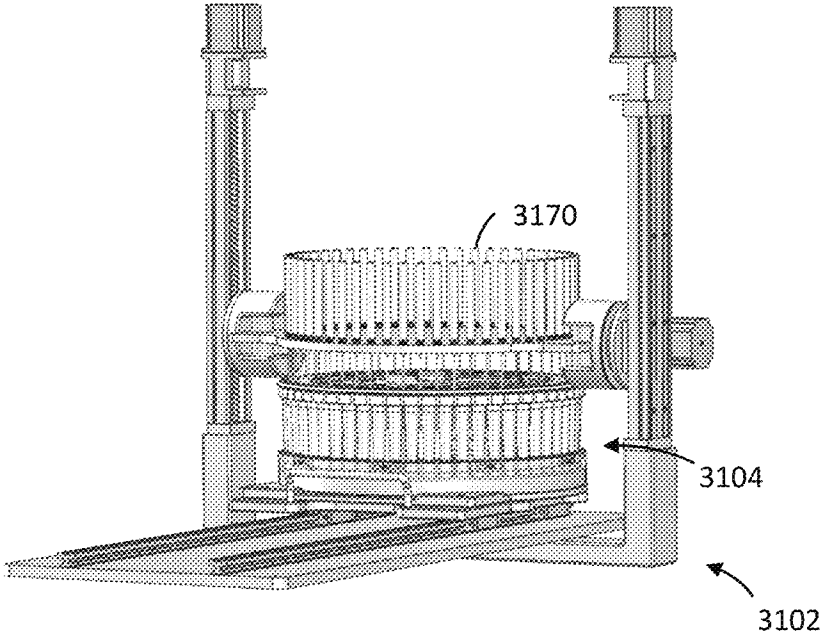
FIG. 15 is a perspective view like that of FIG. 14, and showing the carriage lowered and in the first configuration.

In the example illustrated, the compaction apparatus 3100 includes a frame 3102 for removably receiving a cone pallet 3104. The cone pallet 3104 includes a plurality of pallet cavities 3106. In the example illustrated, the apparatus 3100 includes a compaction mechanism 3118 positionable above the cone pallet 3104. In the example illustrated, the compaction mechanism 3118 includes at least one pin 3122 alignable with the open upper end of a respective cone (and with the pallet cavity). Referring to FIGS. 14 and 15, when aligned, the pin 3122 is movable vertically relative to the cone pallet 3104 from a pin retracted position (FIG. 14) toward a pin advanced position (FIG. 15). In the example illustrated, the compaction mechanism 3118 further includes at least one vibratory drive operable to vibrate the pins 3122.

Figure 17:
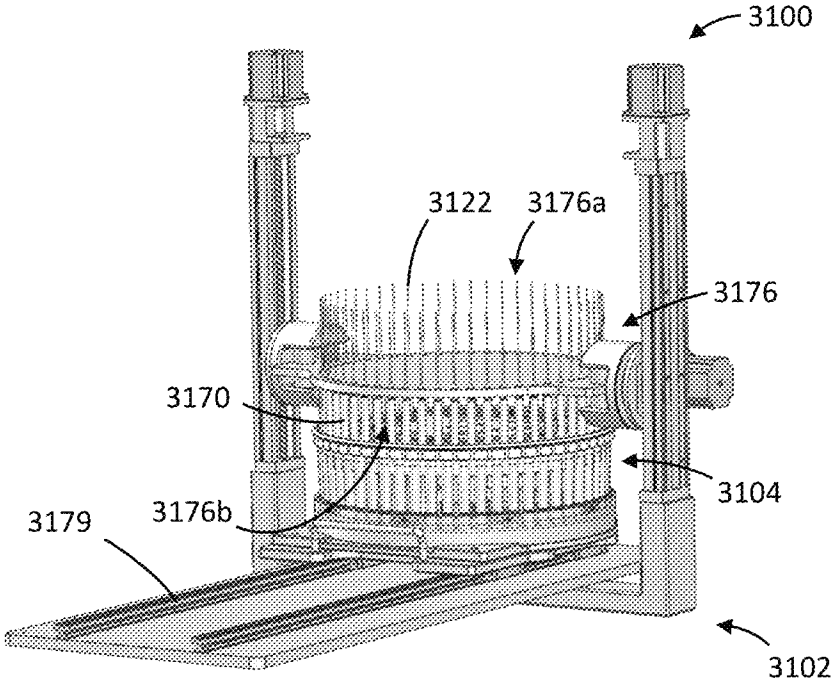
FIG. 17 is a perspective view like that of FIG. 14, and showing the carriage lowered and in the second configuration.

In the example illustrated, the compaction mechanism 3118 includes at least one tamping rod 3170 spaced apart from the pin 3122 and having a tamping face 3156 (FIG. 16) alignable with the open upper end of the respective cone (and with the pallet cavity). Referring to FIG. 17, when aligned, the tamping face 3156 is movable relative to the cone pallet 3104 between a tamping retracted position and a tamping advanced position (shown in FIG. 17).

Figure 16:
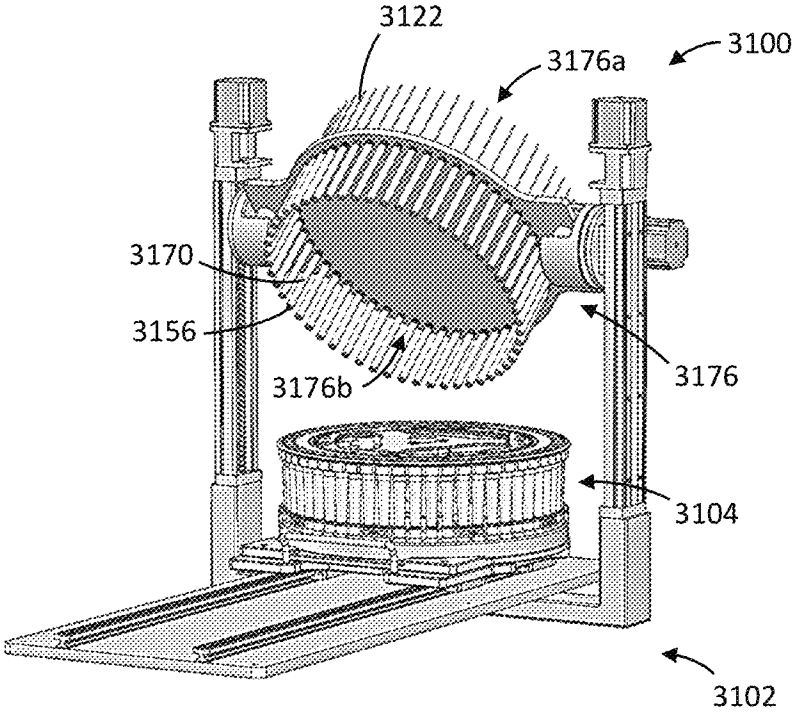
FIG. 16 is a perspective view like that of FIG. 14, and showing the carriage raised and transitioning between first and second configurations.

Referring to FIG. 16, in the example illustrated, the compaction mechanism 3118 includes a rotatable carriage 3176 mounted to the frame 3102 and holding the pins 3122 and rods 3170. The carriage 3176 has a first side 3176*a* and a second side 3176*b* spaced rotationally apart from the first side 3176*a*. In the example illustrated, the second side 3176*b* is generally opposite the first side, spaced rotationally apart from the first side 3176*a* by about 180 degrees. In the example illustrated, the at least one pin 3122 projects from the first side 3176*a* and the at least one tamping rod 3170 projects from the second side 3176*b*. The carriage 3176 is rotatable relative to the frame 3102 between a first rotary position and a second rotary position. Referring to FIGS. 14 and 15, when the carriage is in the first rotary position, the first side 3176*a* and the at least one pin 3122 are directed downwardly and the pin 3122 is in alignment with a respective pallet cavity (and the open upper end of a respective cone held therein). Referring to FIG. 17, when the carriage 3176 is in the second rotary position, the second side 3176*b* and the tamping face 3156 (FIG. 16) of the at least one tamping rod 3170 are directed downwardly and the tamping face 3156 is in alignment with the open upper end of the cone (and pallet cavity).

In the example illustrated, the carriage 3176 is vertically translatable relative to the cone pallet 3104 for moving the pin 3122 between the pin advanced and pin retracted positions when the carriage is in the first rotary position, and for moving the tamping face 3156 between the tamping advanced and tamping retracted positions when the carriage in the second rotary position. In the example illustrated, the compaction mechanism 3118 includes one or more actuators 3129 for rotating the carriage between the first and second rotary positions, and for vertically translating the carriage 3176 relative to the cone pallet 3104. In the example illustrated, the carriage 3176 is also vertically translatable relative to the frame 3102. In the example illustrated, the cone pallet 3104 is horizontally translatable along one or more rails 3179 between a cone pallet retracted position and a cone pallet advanced position. When in the cone pallet retracted position, the cone pallet 3104 is clear of the carriage 3176 (e.g. to facilitate loading and unloading the cone pallet 3104 into and out from the apparatus 3100). When in the cone pallet advanced position, the cone pallet 3104 is positioned under the carriage 3176 for alignment with the pins 3122 (when the carriage 3176 is in the first rotary position) or the tamping faces 3156 (when the carriage 3176 is in the second rotary position).

Figure 18:
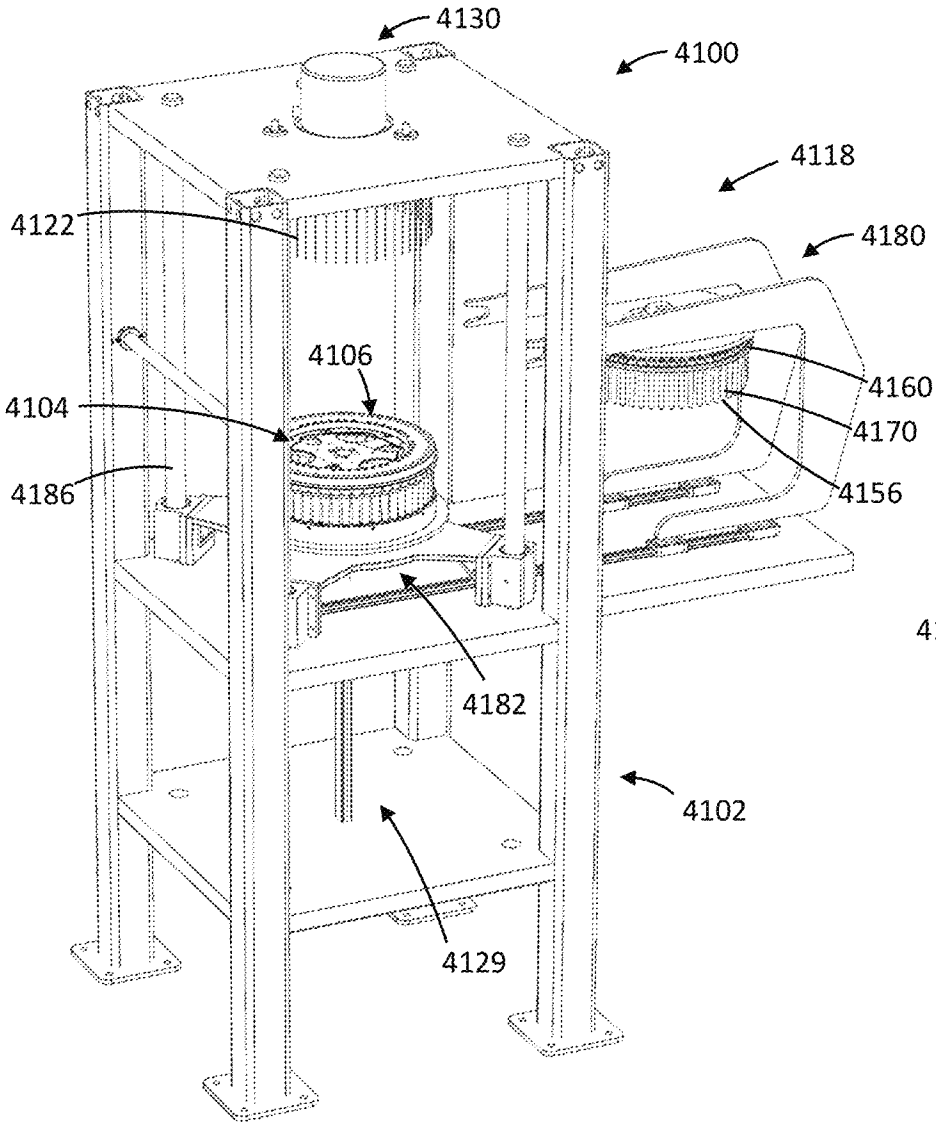
FIG. 18 is a perspective view of another example compaction apparatus, showing a translatable carriage of the apparatus in a retracted configuration.

Referring to FIG. 18, another example compaction apparatus 4100 is shown. The compaction apparatus 4100 has similarities to the apparatus 3100, and like features are identified with like reference characters, incremented by 1000.

In the example illustrated, the compaction apparatus 4100 includes a frame 4102 for removably receiving a cone pallet 4104 having a plurality of pallet cavities 4106. In the example illustrated, the apparatus 4100 includes a compaction mechanism 4118 positionable above the cone pallet 4104. In the example illustrated, the compaction mechanism 4118 includes at least one pin 4122 alignable with the open upper end of a respective cone (and pallet cavity 4106). When aligned, the pin 4122 is movable vertically relative to the cone pallet 4104 from a pin retracted position toward a pin advanced position. In the example illustrated, the compaction mechanism 4118 includes a plurality of the pins 4122 held by a pin carrier. In the example illustrated, the compaction mechanism 4118 further includes at least one vibratory drive 4130 operable to vibrate the pins 4122 (e.g. through vibration of the pin carrier).

Figure 19:
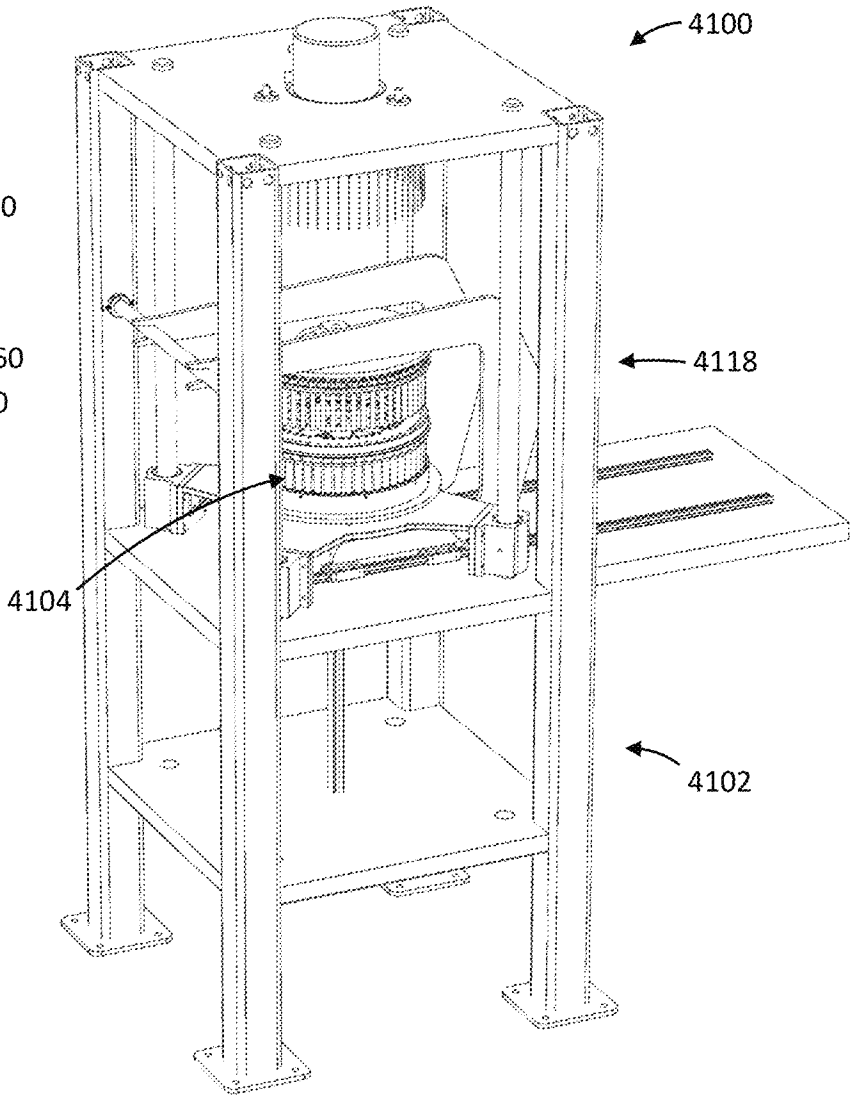
FIG. 19 is a perspective view like that of FIG. 18, and showing the carriage in an advanced configuration.

In the example illustrated, the compaction mechanism 4118 includes at least one tamping rod 4170 spaced apart from the pin 4122 and having a tamping face 4156 alignable with the open upper end of the respective cone (and pallet cavity 4106). Referring to FIG. 19, when aligned, the tamping face 4156 is movable relative to the cone pallet 4104 between a tamping retracted position and a tamping advanced position for exerting a compressive force on an upper surface of the smokeable product. In the example illustrated, the compaction mechanism 4118 includes a plurality of the tamping rods 4170 held by a tamper carrier 4160 (FIG. 18).

Referring to FIG. 18, in the example illustrated, the compaction mechanism 4118 includes a carriage 4180 movably supported by the frame 4102, and one of the at least one pin 4122 and the at least one tamping rod 4170 is mounted to the carriage 4180. In the example illustrated, the other one of the at least one pin 4122 and the at least one tamping rod 4170 is supported by the frame 4102 above the cone pallet 4104 and in alignment with the open upper end of a respective cone (and a respective pallet cavity 4106). In the example illustrated, the tamper carrier 4160 and the plurality of tamping rods 4170 are mounted to the carriage 4180, and the pin carrier and the plurality of pins 4122 are supported by the frame 4102 above the cone pallet 4104.

In the example illustrated, the carriage 4180 is movable between a carriage retracted position (FIG. 18) and a carriage advanced position (FIG. 19). Referring to FIG. 18, when the carriage 4180 is in the carriage retracted position, the carriage 4180 and the tamping rods 4170 are horizontally clear of the cone pallet 4104, and the pins 4122 are movable toward the pin advanced position. Referring to FIG. 19, when the carriage 4180 is in the carriage advanced position, the tamping faces 4156 are in alignment with the open upper end of respective cones (and cone cavities 4106) and movable toward the tamping advanced position. In the example illustrated, the tamping rods 4156 are aligned with and spaced vertically below the pins 4122 when the carriage 4180 is in the carriage advanced position.

In the example illustrated, the compaction mechanism 4118 further includes one or more actuators 4129 supported by the frame 4102 for moving the pins 4122 between the pin advanced and pin retracted positions and for moving the tamping faces 4156 between the tamping advanced and tamping retracted positions. In the example illustrated, the one or more actuators 4129 include a pallet actuator 4182 for vertically translating the cone pallet 4104 away from and towards a pallet lowered position. The pallet lowered position corresponds to the pin retracted position and the tamping retracted position. In the example illustrated, when the carriage 4180 is in the carriage retracted position, the pallet actuator 4182 is operable to raise the cone pallet 4104 from the pallet lowered position toward the pins 122 to move the pins 4122 toward the pin advanced position. In the example illustrated, when the carriage 4180 is in the carriage advanced position, the pallet actuator 4182 is operable to raise the cone pallet 4104 from the pallet lowered position toward the tamping faces 4156 to move the tamping faces 4156 toward the tamping advanced position.

In the example illustrated, pallet actuator 4182 comprises a plurality of guides 4186 fixed relative to the frame 4102 for guiding vertical movement of the cone pallet 4104. In the example illustrated, the guides 4186 comprise vertical shafts.

Figure 21:
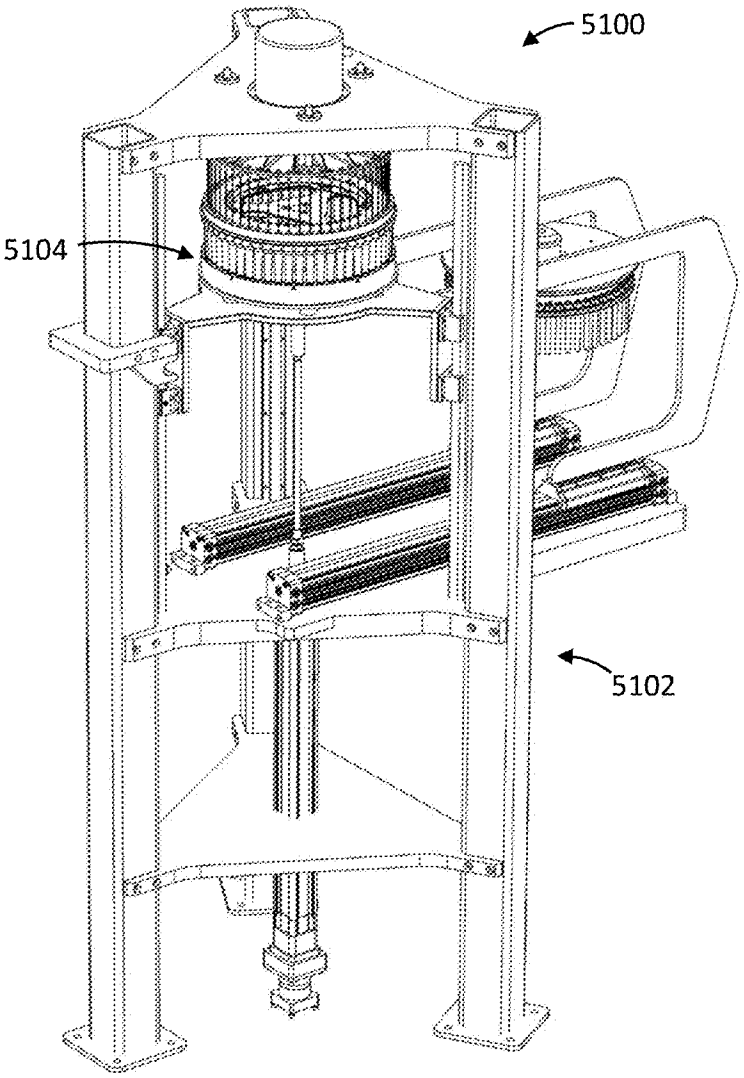
FIG. 21 is a perspective view like that of FIG. 20, and showing the pallet portion in a raised configuration.
Figure 20:
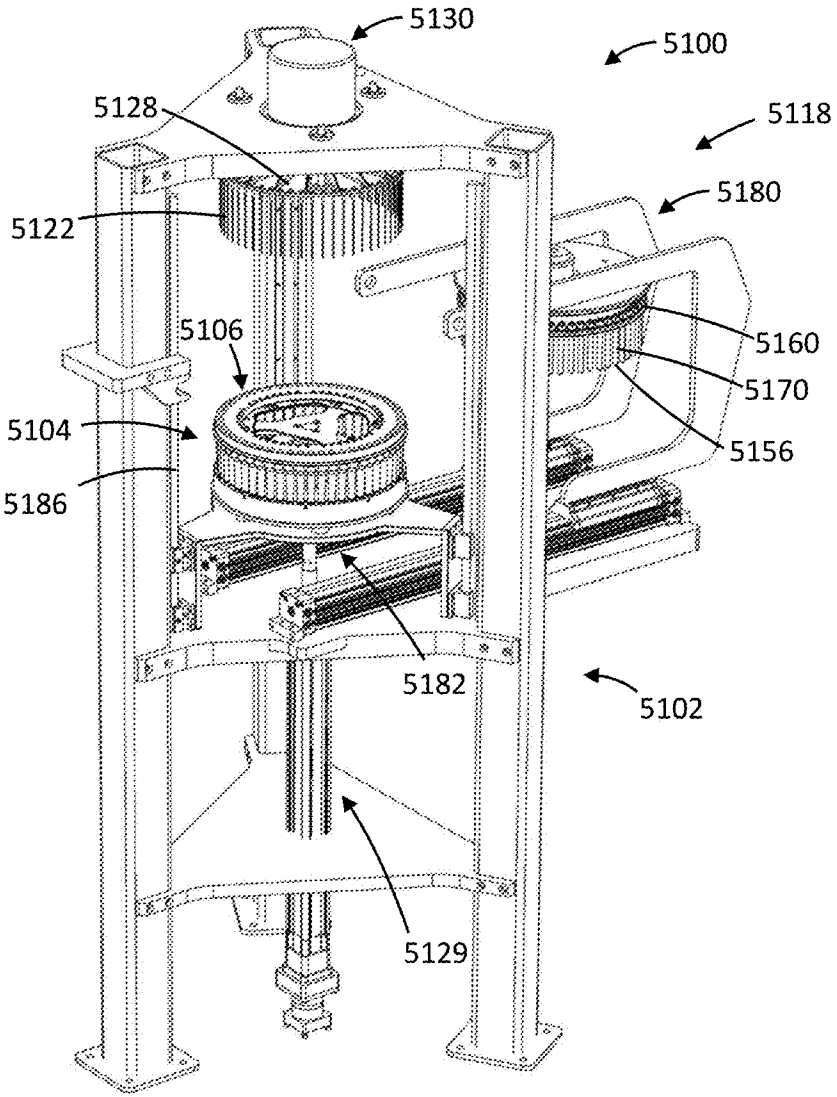
FIG. 20 is a perspective view of another example compaction apparatus, showing a pallet portion of the apparatus in a lowered configuration.

Referring to FIGS. 20 and 21, another example compaction apparatus 5100 is shown. The compaction apparatus 5100 has similarities to the apparatus 4100, and like features are identified with like reference characters, incremented by 1000.

In the example illustrated, the compaction apparatus 5100 includes a frame 5102 for removably receiving a cone pallet 5104, and a compaction mechanism 5118 positionable above the cone pallet 5104. In the example illustrated, the compaction mechanism 5118 includes: a plurality of pins 5122 held by a pin carrier 5128 and movable between a pin retracted and a pin advanced position; a vibratory drive 5130 operable to vibrate the pins 5122; a plurality of tamping rods 5170 with respective tamping faces 5156 movable between a tamping retracted position and a tamping advanced position; a carriage 5180 carrying the tamping rods 5170 and translatable between a carriage retracted position and a carriage advanced position; and one or more actuators 5129, including a pallet actuator 5182 for raising and lowering the cone pallet 5104 between a lowered position (FIG. 20) and a raised position (FIG. 21). In the example illustrated, the pallet actuator 5182 includes a plurality of guides 5186 fixed relative to the frame 5102 for guiding movement of the cone pallet 5104 between the raised and lowered positions. In the example illustrated, the guides 5186 comprise vertical rails.

Referring to FIGS. 22A and 22B, another example compaction apparatus 6100 is shown. The compaction apparatus 6100 has similarities to the apparatus 5100, and like features are identified with like reference characters, incremented by 1000.

In the example illustrated, the compaction apparatus 6100 includes a frame 6102 for removably receiving a cone pallet 6104 (shown schematically in dashed lines). The frame 6102 includes a housing 6190, and at least a portion of the cone pallet 6104 is receivable in a chamber of the housing 6190. A dosing tray 6192 is disposed above the pallet 6104 to facilitate filling of the cones (e.g. cones 12) supported in the pallet 6104 with the smokeable product. The dosing tray 6192 includes a plurality of transfer sleeves 6194. Each transfer sleeve 6194 has an upper sleeve end for receiving smokeable product from a dispensing assembly 6196, and a lower sleeve end for dispensing the smokeable product into a respective cone held in the cone pallet 6104.

In the example illustrated, the compaction apparatus 6100 includes a compaction mechanism 6118 positionable above the cone pallet 6104. The compaction mechanism 6118 includes at least one pin 6122 alignable with the open upper end of a respective cone (and pallet cavity) in the cone pallet 6104. Referring to FIG. 22B, when aligned, the at least one pin 6122 is movable vertically relative to the cone pallet 6104 between a pin retracted position and a pin advanced position. In the example illustrated, when the pin is moved from the pin retracted position toward the pin advanced position (for insertion of the pin 6122 into the smokeable product held in a respective cone in the cone pallet 6104), the pin 6122 passes through a respective transfer sleeve 6194 of the dosing tray 6192.

In the example illustrated, the compaction mechanism 6118 includes a plurality of the pins 6122 held by a pin carrier 6128, and a manipulator 6129 for moving the pin carrier 6128 relative to the cone pallet 6104. In the example illustrated, the manipulator 6129 is operable to move the pin carrier 6128 laterally between a station-clear position (FIG. 22A) in which the pin carrier 6128 is laterally spaced apart from the pallet 6104, and a station-engaged position (FIG. 22B) in which the pin carrier 6128 is in vertical registration with the pallet 6104. Moving the pin carrier to the station-clear position moves the pin carrier 6128 (and the pins 6122) clear of the cone pallet 6104 and the dosing tray 6192, which can facilitate removing filled cone pallets from the frame 6102 and inserting empty cone pallets in the frame 6102 for filling of the cones held therein with the smokeable product.

Alternatively or additionally, the manipulator 6129 can be operable to move the pin carrier 6128 vertically. In the example illustrated, the manipulator 6129 is operable to move the pin carrier 6128 vertically, and when the pin carrier 6128 is in the station-engaged position, the manipulator 6129 is operable to move the pins 6122 between the pin retracted and pin advanced positions (for compaction, as described in more detail previously). The manipulator can include one or more linear or rotary actuators, and in the example illustrated, the manipulator 6129 includes a multi-axis robot arm.

Figure 23:
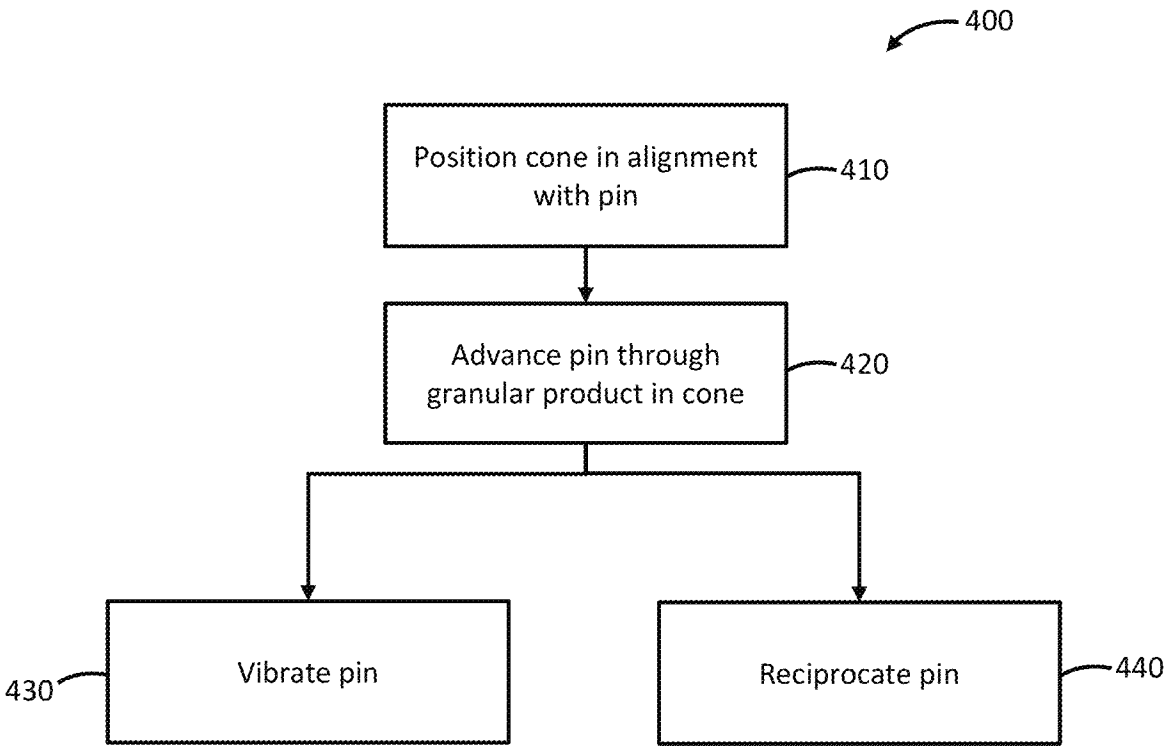
FIG. 23 is a flow chart showing another example process for production of conical smoking articles using a compaction apparatus like that disclosed in the present specification.

Referring to FIG. 23, an example process 400 for production of smoking articles using a compaction apparatus similar to the compaction apparatuses of the present specification is shown, and will be described with respect to the compaction apparatus 1100. At step 410 of the process 400, a respective cone 12 received in the cone pallet 1104 and holding a volume of the smokeable product 30 is positioned in alignment with a respective pin 1122. At step 420, the pin 1122 is advanced into the volume of the smokeable product 30 through the open upper end 22 of the cone 12. At step 430, when the pin 1122 is in the volume of the smokeable product 30, the pin 1122 is vibrated to induce settlement of the smokeable product 30.

Figure 24:
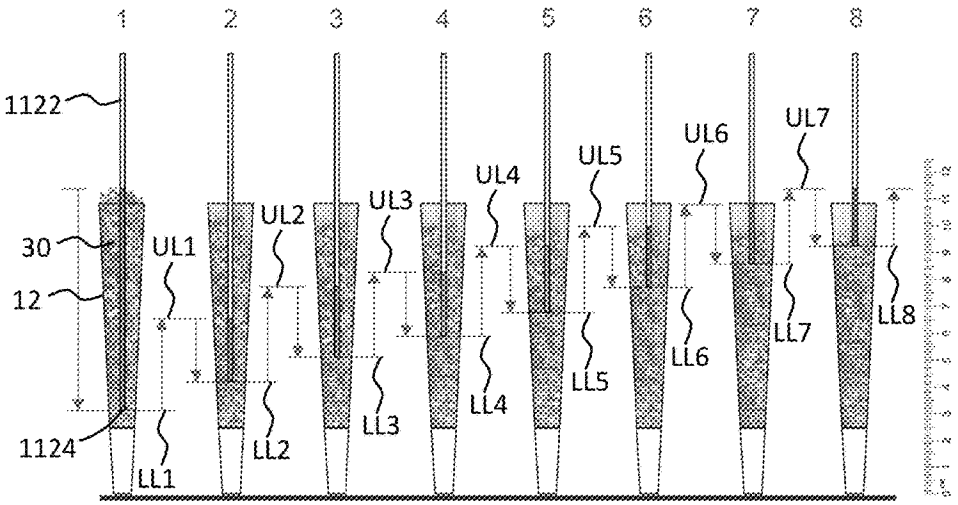
FIG. 24 is a schematic showing an example method of reciprocating a pin during a compaction process like that of FIG. 23.

At step 440, the pin 1122 is reciprocated along a vertical axis in the volume of the smokeable product 30. Referring to FIG. 24, in the example illustrated, the reciprocating step 440 includes vertically translating the tip 1124 of the pin 1122 in successive strokes over a time period between a lower limit (LL) and an upper limit (UL) above the lower limit, and raising the lower limit over the time period (e.g. from LL1 to LL8 in FIG. 24). Each stroke can have a stroke length between the lower and upper limit of, for example, at least 10 mm. In the example shown in FIG. 24, the reciprocating step 340 includes raising the upper limit over the time period (e.g. from UL1 to UL7), and coordinating the raising of the upper and lower limits to maintain a generally common stroke length of the pin 1122 over at least a portion of the time period.

Figure 25:
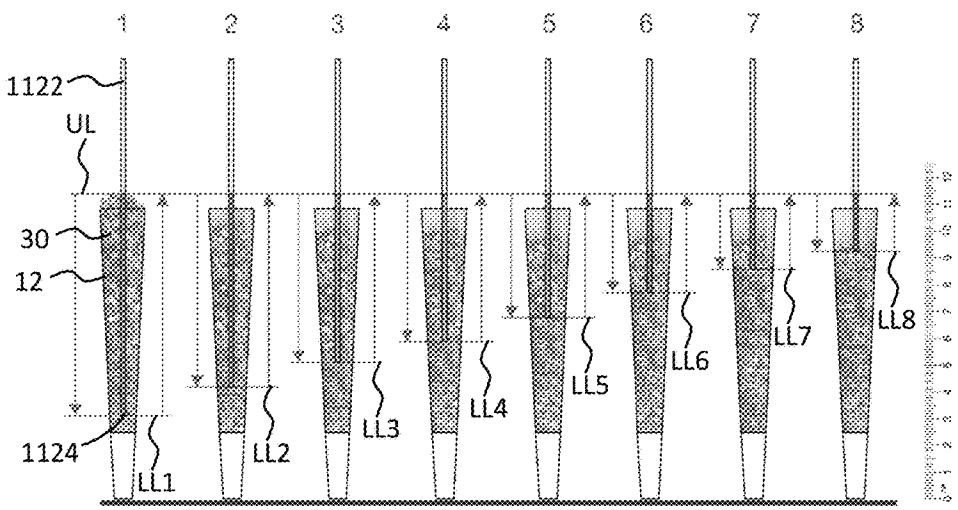
FIG. 25 is a schematic showing another example method of reciprocating a pin during a compaction process like that of FIG. 23.

Referring to FIG. 25, in the example illustrated, the reciprocating step 340 includes maintaining the upper limit at a generally common elevation over the time period to reduce a stroke length of the pin 1122 when the lower limit is raised (e.g. from LL1 to LL8 in FIG. 25).

The process 400 can optionally include the step of, after steps 430 and 440, withdrawing the pin 1122 from the volume of the smokeable product 30 and urging the tamping face 1156 downwardly against an upper surface of the smokeable product 30 to exert a compressive force thereon.

When used with the apparatus 1100, the process 400 can optionally include the step of translating the pin 1122 relative to the tamping collar 1132 through which the pin 1122 extends to bring the tip 1124 of the pin 1122 and an annular front face 1134 of the collar 1132 into vertical alignment so that the tip 1124 of the pin 1122 and the front face 1134 form the tamping face 1156.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A compaction apparatus for compacting a smokeable product in production of smoking articles, comprising:

a) a frame for removably receiving a cone pallet, the cone pallet including a plurality of cavities, each cavity holding a respective cone filled with a volume of the smokeable product, each cone having an open upper end;

b) a compaction mechanism supported by the frame, the compaction mechanism including:

i. at least one pin extending along a pin axis and alignable above the open upper end of a respective cone, and when aligned, the pin movable vertically relative to the cone pallet from a retracted position, in which the pin is spaced apart from the smokeable product in the respective cone, toward an advanced position for inserting a lower portion of the pin into the volume of the smokeable product in the respective cone; and ii. a vibratory drive coupled to the pin, the vibratory drive operable to vibrate the pin when the lower portion of the pin is within the volume of the smokeable product of the respective cone for inducing settlement of the smokeable product;

wherein the compaction mechanism includes (iii) a collar positionable in the open upper end of the cone atop the smokeable product for generally covering the open upper end when the pin is in the advanced position, wherein the collar includes a front face for bearing against an upper surface of the smokeable product in the respective cone for exerting a compressive force on the smokeable product.

2. The apparatus of claim 1, wherein the collar has an interior aperture for slidably receiving the pin therethrough, and when the collar is positioned atop the smokeable product, the pin translates relative to the collar during movement toward the advanced position.

3. The apparatus of claim 1, further comprising a plunger attached to the pin above a rear face of the collar, the rear face opposite the front face, wherein the plunger is spaced apart from the rear face of the collar when the pin is in the retracted position, and the plunger bears against the rear face of the collar when the pin is in the advanced position for pushing the collar downwardly to exert the compressive force.

4. The apparatus of claim 3, wherein the collar is formed of a generally rigid material, and the plunger is formed of a generally elastic material.

5. The apparatus of claim 1, wherein each cavity has a cavity height between an upper end of the cavity and a lower end of the cavity, and wherein the pin advances through at least 20% of the cavity height when moving toward the advanced position.

6. The apparatus of claim 5, wherein the pin advances through at least 50% of the cavity height when moving toward the advanced position.

7. The apparatus of claim 1, wherein the vibratory drive is tunable to adjust at least one of a vibration frequency and a vibration amplitude for vibrating the pin.

8. The apparatus of claim 1, wherein the pin has a pin outer diameter greater than 1.1 mm.

9. The apparatus of claim 7, wherein the pin outer diameter is greater than 1.3 mm.

10. The apparatus of claim 1, wherein the vibratory drive is operable to initiate vibration of the pin prior to insertion of the pin into the volume of the smokeable product.

11. A method of compacting a smokeable product in a cone for production of smoking articles, the method comprising:

a) positioning a respective cone of a cone pallet in alignment with a pin, the cone containing a volume of the smokeable product and having an open upper end;

b) advancing the pin into the volume of the smokeable product through the open upper end of the cone;

c) when the pin is in the volume of the smokeable product, vibrating the pin to induce settlement of the smokeable product in the cone;

(d) positioning a col lar in the open upper end of the cone atop the smokeable product to generally cover the open upper end when the pin is in the volume of the smokeable product; and (e) urging the collar downwardly to exert a compressive force on the smokeable product.

12. The method of claim 11, wherein step (c) and step (e) are performed simultaneously.

13. The method of claim 11, wherein the collar is urged downwardly via a plunger attached to the pin above the collar.

14. The method of claim 11, wherein step (e) includes exerting the compressive force for at least 8 seconds.

15. The method of claim 11, wherein step (b) includes advancing the pin through the collar while the collar is atop the smokeable product.

16. The method of claim 11, further comprising withdrawing the pin from the smokeable product while the collar is atop the smokeable product.

17. The method of claim 11, further comprising vibrating the pin while the pin is being advanced through the smokeable product.

18. The method of claim 11, further comprising vibrating the pin while the pin is being withdrawn from the smokeable product.

19. The method of claim 11, wherein step (c) includes vibrating the pin for at least 8 seconds.

20. The method of claim 11, further comprising tuning at least one of a vibration frequency and a vibration amplitude for vibrating the pin.

21. The method of claim 11, further comprising initiating vibration of the pin prior to advancement of the pin into the volume of the smokeable product.

22. The method of claim 11, further comprising, after step (b), reciprocating the pin along a vertical axis in the volume of the smokeable product.

23. The method of claim 22, wherein the reciprocating step includes vertically translating a tip of the pin in successive strokes over a time period between a lower limit and an upper limit above the lower limit, and raising the lower limit over the time period.

24. The method of claim 23, wherein the reciprocating step includes raising the upper limit over the time period.

25. The method of claim 24, wherein the raising of the upper and lower limits is coordinated to maintain a generally common stroke length of the pin over the time period.

26. The method of claim 23, wherein the upper limit remains at a generally common elevation over the time period to reduce a stroke length of the pin when the lower limit is raised.

27. The method of claim 11, further comprising, after step (c), withdrawing the pin from the volume of the smokeable product and urging a tamping face downwardly against an upper surface of the smokeable product to exert a compressive force thereon.

28. The method of claim 27, further comprising, translating the pin relative to a tamping collar through which the pin extends to bring a tip of the pin and an annular front face of the collar into vertical alignment for forming the tamping face.

29. A compaction apparatus for compacting a smokeable product in production of smoking articles, comprising:

a) a frame defining at least one station for removably receiving a cone pallet, the cone pallet including a plurality of cavities, each cavity configured to hold a respective cone filled with a volume of smokeable product;

b) a compaction mechanism positionable above the cone pallet when the cone pallet is received in the station, the compaction mechanism including:

i. at least one pin extending along a pin axis and alignable with a respective cavity, and when aligned, the pin movable vertically relative to the cone pallet from a pin retracted position distal the cone pallet toward a pin advanced position proximate the cone pallet for inserting a lower portion of the pin into the volume of smokeable product in the cone in the respective cavity; and ii. a vibratory drive coupled to the pin, the vibratory drive operable to vibrate the pin at least when the pin is in the pin advanced position;

wherein the compaction mechanism further includes at least one tamping collar having an annular front face directed toward the cone pallet and an interior aperture open to the front face and receiving a respective pin, the collar axially movable relative to the pin between a collar rearward position and a collar forward position.

30. The apparatus of claim 29, wherein when the collar is in the collar rearward position, the lower portion of the pin projects downwardly from the front face of the collar to facilitate movement of the pin toward the pin advanced position, and when the collar is in the collar forward position, the annular front face of the collar and a tip of the pin form a tamping face, the tamping face moveable from a tamping retracted position distal the cone pallet to a tamping advanced position proximate the cone pallet for urging the tamping face downwardly against an upper surface of the volume of smokeable product to exert a compressive force thereon.

31. The apparatus of claim 30, wherein the annular front face of the collar and the tip of the pin are generally flush when the collar is in the collar forward position.

32. The apparatus of claim 30, further comprising: a pin carrier supported by the frame and holding the at least one pin; a tamper carrier supported by the frame and holding the at least one tamping collar; and an actuator operable to translate the tamper carrier relative to the pin carrier for moving the at least one collar between the collar rearward and collar forward positions.

33. The apparatus of claim 32, wherein the tamper carrier is releasably fixable in position relative to the pin carrier when the collar is in the collar forward position.

34. The apparatus of claim 29, wherein the compaction mechanism includes at least one tamping rod spaced apart from the pin and having a tamping face alignable with a respective cavity.

35. The apparatus of claim 34, wherein the tamping face is moveable relative to the cone pallet from a tamping retracted position distal the cone pallet to a tamping advanced position proximate the cone pallet for urging the tamping face downwardly against an upper surface of the volume of smokeable product to exert a compressive force thereon.

36. The apparatus of claim 34, wherein the pin tip has a pin tip diameter, and the tamping face has a tamping face diameter greater than the pin tip diameter.

37. The apparatus of claim 34, wherein the frame has a first station below the at least one pin and a second station below the at least one tamping rod and spaced horizontally apart from the first station, and the cone pallet is moveable relative to the frame from the first station to the second station.

38. The apparatus of claim 37, wherein when the cone pallet is in the first station, the at least one pin is alignable with the respective cavity, and when the cone pallet is in the second station, the tamping face of the at least one rod is alignable with the respective cavity.

39. The apparatus of claim 34, wherein the compaction mechanism includes a rotatable carriage mounted to the frame, the carriage including a first side from which the at least one pin projects and a second side spaced rotationally apart from the first side and from which the at least one tamping rod projects.

40. The apparatus of claim 39, wherein the carriage is rotatable relative to the frame between a first position, in which the first side and the at least one pin are directed toward the cone pallet, and a second position in which the second side and the tamping face of the at least one tamping rod are directed toward the cone pallet.

41. The apparatus of claim 34, wherein the compaction mechanism includes a carriage movably supported by the frame, wherein one of the at least one pin and the at least one tamping rod is mounted to the carriage.

42. The apparatus of claim 41, wherein the carriage is movable between a carriage retracted position and a carriage advanced position, wherein when the carriage is in the carriage retracted position, the one of the at least one pin and the at least one tamping rod is horizontally clear of the cone pallet, and when the carriage is in the carriage advanced position, the one of the at least one pin and the at least one tamping rod is alignable with the respective cavity of the cone pallet.

43. The apparatus of claim 41, wherein the other one of the at least one pin and the at least one tamping rod is supported by the frame above the cone pallet and in alignment with the respective cavity.

44. The apparatus of claim 43, wherein the at least one pin is supported by the frame, and the at least one tamping rod is supported by the carriage, the at least one tamping rod aligned with, and spaced vertically below, the at least one pin when the carriage is in the carriage advanced position.

45. The apparatus of claim 41, further comprising a pallet actuator for vertically translating the cone pallet away from and towards a pallet lowered position, the pallet lowered position corresponding to the pin retracted position and the tamping retracted position.

* * * * *